US006500796B1

(12) United States Patent
Ceulemans et al.

(10) Patent No.: US 6,500,796 B1
(45) Date of Patent: Dec. 31, 2002

(54) STABILIZED FABRIC SOFTENING COMPOSITIONS

(75) Inventors: Raphael Angeline Alfons Ceulemans, Lubbeek (BE); Axel Masschelein, Brussels (BE); Christiaan Arthur Jacques Kamiel Thoen, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/554,699

(22) PCT Filed: Nov. 20, 1998

(86) PCT No.: PCT/US98/24838

§ 371 (c)(1),
(2), (4) Date: May 18, 2000

(87) PCT Pub. No.: WO99/27056

PCT Pub. Date: Jun. 3, 1999

(30) Foreign Application Priority Data

Nov. 24, 1997 (EP) ..... 97870187
Jun. 27, 1998 (EP) ..... 98202164

(51) Int. Cl.[7] ..... C11D 7/02; C11D 7/08
(52) U.S. Cl. ..... 510/513; 510/515
(58) Field of Search ..... 510/513, 515, 510/517

(56) References Cited

U.S. PATENT DOCUMENTS 5,518,646 A 5/1996 Van den Brom ..... 252/174
5,726,280 A 3/1998 Uhr et al. ..... 528/328
5,853,430 A * 12/1998 Shindo et al. ..... 8/137
6,291,411 B1 * 9/2001 Callaghan et al. ..... 510/191

FOREIGN PATENT DOCUMENTS

| | | | |
|---|---|---|---|
| EP | 112593 | 7/1984 | C11D/3/30 |
| EP | 462806 | 12/1991 | C11D/3/40 |
| EP | 753565 | 1/1997 | C11D/1/62 |
| GB | 2303146 | 2/1997 | C11D/1/62 |
| WO | WO 95/27038 | 10/1995 | C11D/17/00 |
| WO | WO 95/32272 | 11/1995 | C11D/3/37 |
| WO | WO 96/21714 | 7/1996 | C11D/3/33 |
| WO | WO 96/27649 | 9/1996 | C11D/3/00 |
| WO | WO 97/28207 | 8/1997 | C08G/73/02 |

* cited by examiner

*Primary Examiner*—Yogendra N. Gupta
*Assistant Examiner*—John M Petruncio
(74) *Attorney, Agent, or Firm*—Jason J. Camp; Kim William Zerby; Steven W. Miller

(57) ABSTRACT

A fabric care composition comprises a polyamine functional polymer and a crystal growth inhibitor selected from the group consisting of carboxylic compounds, organic mono and diphosphonic acids, and salts and complexes thereof, and mixture thereof. In one embodiment, the polyamine functional polymer has a molecular weight between 200 and 10,000 and, when the crystal growth inhibitor is selected from carboxylic acid, organic diphosphonic acid, and mixtures thereof, the crystal growth inhibitor is present in an amount of less than 1% by weight of the composition. In another embodiment, the crystal growth inhibitor is present in an amount of from 0.005 to 0.2 percent by weight of the composition.

21 Claims, No Drawings

STABILIZED FABRIC SOFTENING COMPOSITIONS

FIELD OF THE INVENTION

The present invention relates to a fabric care composition comprising a polyamino-functional polymer, whereby effective stabilisation of the composition is obtained.

BACKGROUND OF THE INVENTION

The appearance of colored fabrics, e.g., clothing, bedding, household fabrics such table linens is one of the areas of concern for consumers. Indeed, upon typical consumer's uses of the fabrics such as wearing, washing, rinsing and/or tumble-drying of fabrics, a loss in the fabric appearance; which is at least partly due to loss of color fidelity and color definition, can take place. Such a problem of color loss is even more acute after multiwash cycles.

It is therefore an object of the invention to provide a composition which provides improved color care to the laundered fabrics, especially after multiwash cycles.

Recently, a new class of materials, namely, the amino-functional polymers, have found increasing use in the treatment of fabrics in order to provide care to the color of fabrics.

However, it has now been found that compositions comprising these amino-functional polymers tend to lead to storage stability problem. This problem can be characterised by a yellowing of the composition as well as resulting malodours on the treated fabrics. This problem is even more acute when the product is formulated as a stand-alone product. Indeed, when fully-formulated such as in a softening composition, the perfume present within provides a certain malodour coverage thus rendering the resulting malodour more acceptable. In constrast, for stand alone product, perfume, unless present at very high level, do not sufficiently cover the malodour. High levels of perfume, however, increases the formulation cost. Furthermore, high levels of perfume to cover the malodour still does not provide a long-lasting malodour coverage. Indeed, the perfume will provide instant malodour coverage but upon storage the perfume which contain volatile top-notes will evaporate thus lessening the malodour coverage benefit.

Accordingly, the formulator of a fabric care composition is faced with the dual problem of formulating a composition which provides care to the fabrics without being detrimental to the stability of the composition.

The Applicant has now surprisingly found that the provision of a crystal growth inhibitor to compositions comprising modified amino-functional polymer overcomes the problem.

DETAILED DESCRIPTION OF THE INVENTION

Amino-functional Polymer

An essential component of the invention is an amino-functional polymer. The amino-functional polymer advantageously provides care to the colors of fabrics.

The amino-functional polymers of the present invention are water-soluble or dispersible, polyamines. Typically, the amino-functional polymers for use herein have a molecular weight between 200 and $10^6$, preferably between 600 and 20,000, most preferably between 1000 and 10,000. These polyamines comprise backbones that can be either linear or cyclic. The polyamine backbones can also comprise polyamine branching chains to a greater or lesser degree. Preferably, the polyamine backbones described herein are modified in such a manner that at least one, preferably each nitrogen of the polyamine chain is thereafter described in terms of a unit that is substituted, quaternized, oxidized, or combinations thereof.

For the purposes of the present invention the term "modification" as it relates to the chemical structure of the polyamines is defined as replacing a backbone —NH hydrogen atom by an R' unit (substitution), quaternizing a backbone nitrogen (quaternized) or oxidizing a backbone nitrogen to the N-oxide (oxidized). The terms "modification" and "substitution" are used interchangeably when referring to the process of replacing a hydrogen atom attached to a backbone nitrogen with an R' unit. Quaternization or oxidation may take place in some circumstances without substitution, but substitution is preferably accompanied by oxidation or quaternization of at least one backbone nitrogen.

The linear or non-cyclic polyamine backbones that comprise the amino-functional polymer have the general formula:

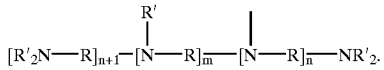

The cyclic polyamine backbones that comprise the amino-functional polymer have the general formula:

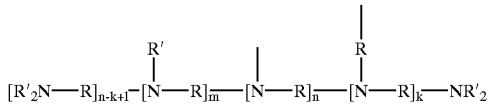

The above backbones prior to optional but preferred subsequent modification, comprise primary, secondary and tertiary amine nitrogens connected by R "linking" units.

For the purpose of the present invention, primary amine nitrogens comprising the backbone or branching chain once modified are defined as V or Z "terminal" units. For example, when a primary amine moiety, located at the end of the main polyamine backbone or branching chain having the structure:

$H_2N$—[R]— is modified according to the present invention, it is thereafter defined as a V "terminal" unit, or simply a V unit. However, for the purposes of the present invention, some or all of the primary amine moieties can remain unmodified subject to the restrictions further described herein below. These unmodified primary amine moieties by virtue of their position in the backbone chain remain "terminal" units. Likewise, when a primary amine moiety, located at the end of the main polyamine backbone having the structure:

—$NH_2$ is modified according to the present invention, it is thereafter defined as a Z "terminal" unit, or simply a Z unit. This unit can remain unmodified subject to the restrictions further described herein below.

In a similar manner, secondary amine nitrogens comprising the backbone or branching chain once modified are defined as W "backbone" units. For example, when a secondary amine moiety, the major constituent of the backbones and branching chains of the present invention, having the structure:

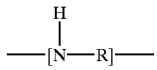

is modified according to the present invention, it is thereafter defined as a W "backbone" unit, or simply a W unit. However, for the purposes of the present invention, some or all of the secondary amine moieties can remain unmodified. These unmodified secondary amine moieties by virtue of their position in the backbone chain remain "backbone" units.

In a further similar manner, tertiary amine nitrogens comprising the backbone or branching chain once modified are further referred to as Y "branching" units. For example, when a tertiary amine moiety, which is a chain branch point of either the polyamine backbone or other branching chains or rings, having the structure:

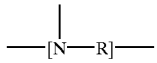

is modified according to the present invention, it is thereafter defined as a Y "branching" unit, or simply a Y unit. However, for the purposes of the present invention, some or all or the tertiary amine moieties can remain unmodified. These unmodified tertiary amine moieties by virtue of their position in the backbone chain remain "branching" units. The R units associated with the V, W and Y unit nitrogens which serve to connect the polyamine nitrogens, are described herein below.

The final modified structure of the polyamines of the present invention can be therefore represented by the general formula:

$$V_{(n+1)}W_mY_nZ$$

for linear amino-functional polymer and by the general formula:

$$V_{(n-k+1)}W_mY_nY'_kZ$$

for cyclic aminofunctional polymer. For the case of polyamines comprising rings, a Y' unit of the formula:

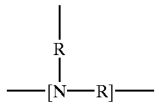

serves as a branch point for a backbone or branch ring. For every Y' unit there is a Y unit having the formula:

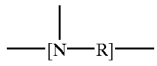

that will form the connection point of the ring to the main polymer chain or branch. In the unique case where the backbone is a complete ring, the polyamine backbone has the formula:

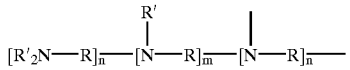

therefore comprising no Z terminal unit and having the formula:

$$V_{n-k}W_mY_nY'_k$$

wherein k is the number of ring forming branching units. Preferably the polyamine backbones of the present invention comprise no rings.

In the case of non-cyclic polyamines, the ratio of the index n to the index m relates to the relative degree of branching. A fully non-branched linear modified polyamine according to the present invention has the formula:

$$VW_mZ$$

that is, n is equal to 0. The greater the value of n (the lower the ratio of m to n), the greater the degree of branching in the molecule. Typically the value for m ranges from a minimum value of 2 to 700, preferably 4 to 400, however larger values of m, especially when the value of the index n is very low or nearly 0, are also preferred.

Each polyamine nitrogen whether primary, secondary or tertiary, once modified according to the present invention, is further defined as being a member of one of three general classes; simple substituted, quaternized or oxidized. Those polyamine nitrogen units not modified are classed into V, W, Y, Y' or Z units depending on whether they are primary, secondary or tertiary nitrogens. That is unmodified primary amine nitrogens are V or Z units, unmodified secondary amine nitrogens are W units or Y' units and unmodified tertiary amine nitrogens are Y units for the purposes of the present invention.

Modified primary amine moieties are defined as V "terminal" units having one of three forms:

a) simple substituted units having the structure:

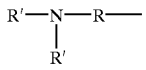

, b) quaternized units having the structure:

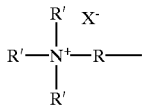

, wherein X is a suitable counter ion providing charge balance; and c) oxidized units having the structure:

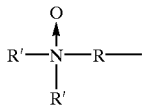

.

Modified secondary amine moieties are defined as W "backbone" units having one of three forms:

a) simple substituted units having the structure:

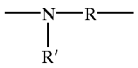

b) quaternized units having the structure:

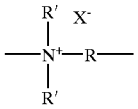

wherein X is a suitable counter ion providing charge balance; and c) oxidized units having the structure:

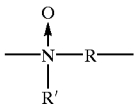

Other modified secondary amine moieties are defined as Y' units having one of three forms:

a) simple substituted units having the structure:

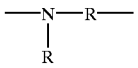

b) quaternized units having the structure:

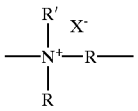

wherein X is a suitable counter ion providing charge balance; and c) oxidized units having the structure:

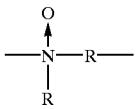

Modified tertiary amine moieties are defined as Y "branching" units having one of three forms:

a) unmodified units having the structure:

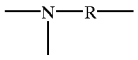

b) quaternized units having the structure:

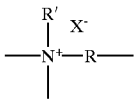

wherein X is a suitable counter ion providing charge balance; and c) oxidized units having the structure:

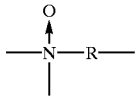

Certain modified primary amine moieties are defined as Z "terminal" units having one of three forms:

a) simple substituted units having the structure:

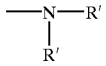

b) quaternized units having the structure:

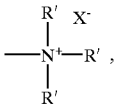

wherein X is a suitable counter ion providing charge balance; and c) oxidized units having the structure:

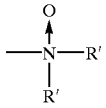

When any position on a nitrogen is unsubstituted of unmodified, it is understood that hydrogen will substitute for R'. For example, a primary amine unit comprising one R' unit in the form of a hydroxyethyl moiety is a V terminal unit having the formula $(HOCH_2CH_2)HN$—.

For the purposes of the present invention there are two types of chain terminating units, the V and Z units. The Z "terminal" unit derives from a terminal primary amino moiety of the structure —$NH_2$. Non-cyclic polyamine backbones according to the present invention comprise only one Z unit whereas cyclic polyamines can comprise no Z units. The Z "terminal" unit can be substituted with any of the R' units described further herein below, except when the Z unit is modified to form an N-oxide. In the case where the Z unit nitrogen is oxidized to an N-oxide, the nitrogen must be modified and therefore R' cannot be a hydrogen.

The polyamines of the present invention comprise backbone R "linking" units that serve to connect the nitrogen atoms of the backbone. R units comprise units that for the purposes of the present invention are referred to as "hydrocarbyl R" units and "oxy R" units. The "hydrocarbyl" R units are $C_2$–$C_{12}$ alkylene, $C_4$–$C_{12}$ alkenylene, $C_3$–$C_{12}$ hydroxyalkylene wherein the hydroxyl moiety may take any position on the R unit chain except the carbon atoms directly connected to the polyamine backbone nitrogens; $C_4$–$C_{12}$ dihydroxyalkylene wherein the hydroxyl moieties may occupy any two of the carbon atoms of the R unit chain except those carbon atoms directly connected to the polyamine backbone nitrogens; $C_8$–$C_{12}$ dialkylarylene which for the purpose of the present invention are arylene moieties having two alkyl substituent groups as part of the linking chain. For example, a dialkylarylene unit has the formula:

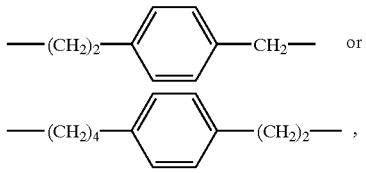

although the unit need not be 1,4-substituted, but can also be 1,2 or 1,3 substituted $C_2$–$C_{12}$ alkylene, preferably ethylene, 1,2-propylene, and mixtures thereof, more preferably ethylene. The "oxy" R units comprise $—(R^1O)_xR^5(OR^1)_x—$, $—CH_2CH(OR^2)CH_2O)_z(R^1O)_yR^1(OCH_2CH(OR^2)CH_2)_w—$, $—CH_2CH(OR^2)CH_2—$, $—(R^1O)_xR^1—$, and mixtures thereof. Preferred R units are selected from the group consisting of $C_2$–$C_{12}$ alkylene, $C_3$–$C_{12}$ hydroxyalkylene, $C_4$–$C_{12}$ dihydroxyalkylene, $C_8$–$C_{12}$ dialkylarylene, $—(R^1O)_x R^1—$, $—CH_2CH(OR^2)CH_2—$, $—(CH_2CH(OH)CH_2O)_z(R^1O)_yR^1(OCH_2CH—(OH)CH_2)_w—$, $—(R^1O)_xR^5(OR^1)_x—$, more preferred R units are $C_2$–$C_{12}$ alkylene, $C_3$–$C_{12}$ hydroxy-alkylene, $C_4$–$C_{12}$ dihydroxyalkylene, $—(R^1O)_xR^1—$, $—(R^1O)_xR^5(OR^1)_x—$, $—(CH_2CH(OH)CH_2O)_z(R^1O)_yR^1(OCH_2CH—(OH)CH_2)_w—$, and mixtures thereof, even more preferred R units are $C_2$–$C_{12}$ alkylene, $C_3$ hydroxyalkylene, and mixtures thereof, most preferred are $C_2$–$C_6$ alkylene. The most preferred backbones of the present invention comprise at least 50% R units that are ethylene.

$R^1$ units are $C_2$–$C_6$ alkylene, and mixtures thereof, preferably ethylene.

$R^2$ is hydrogen, and $—(R^1O)_xB$, preferably hydrogen.

$R^3$ is $C_1$–$C_{18}$ alkyl, $C_7$–$C_{12}$ arylalkylene, $C_7$–$C_{12}$ alkyl substituted aryl, $C_6$–$C_{12}$ aryl, and mixtures thereof, preferably $C_1$–$C_{12}$ alkyl, $C_7$–$C_{12}$ arylalkylene, more preferably $C_1$–$C_{12}$ alkyl, most preferably methyl. $R^3$ units serve as part of R' units described herein below.

$R^4$ is $C_1$–$C_{12}$ alkylene, $C_4$–$C_{12}$ alkenylene, $C_8$–$C_{12}$ arylalkylene, $C_6$–$C_{10}$ arylene, preferably $C_1$–$C_{12}$ alkylene, $C_8$–$C_{12}$ arylalkylene, more preferably $C_2$–$C_8$ alkylene, most preferably ethylene or butylene.

$R^5$ is $C_1$–$C_{12}$ alkylene, $C_3$–$C_{12}$ hydroxyalkylene, $C_4$–$C_{12}$ dihydroxyalkylene, $C_8$–$C_{12}$ dialkylarylene, $—C(O)—$, $—C(O)NHR^6NHC(O)—$, $—C(O)(R^4)_rC(O)—$, $—R^1(OR^1)—$, $—CH_2CH(OH)CH_2O(R^1O)_yR^1OCH_2CH(OH)CH_2—$, $—C(O)(R^4)_rC(O)—$, $—CH_2CH(OH)CH_2—$, $R^5$ is preferably ethylene, $—C(O)—$, $—C(O)NHR^6NHC(O)—$, $—R^1(OR^1)—$, $—CH_2CH(OH)CH_2—$, $—CH_2CH(OH)CH_2O(R^1O)_yR^1OCH_2CH—(OH)CH_2—$, more preferably $—CH_2CH(OH)CH_2—$.

$R^6$ is $C_2$–$C_{12}$ alkylene or $C_6$–$C_{12}$ arylene.

The preferred "oxy" R units are further defined in terms of the $R^1$, $R^2$, and $R^5$ units. Preferred "oxy" R units comprise the preferred $R^1$, $R^2$, and $R^5$ units. The preferred cotton soil release agents of the present invention comprise at least 50% $R^1$ units that are ethylene. Preferred $R^1$, $R^2$, and $R^5$ units are combined with the "oxy" R units to yield the preferred "oxy" R units in the following manner.

i) Substituting more preferred $R^5$ into $—(CH_2CH_2O)_xR^5(OCH_2CH_2)_x—$ yields $—(CH_2CH_2O)_xCH_2CHOHCH_2(OCH_2CH_2)_x—$.

ii) Substituting preferred $R^1$ and $R^2$ into $—(CH_2CH(OR^2)CH_2O)_z—(R^1O)_yR^1O(CH_2CH(OR^2)CH_2)_w—$ yields $—(CH_2CH(OH)CH_2O)_z—(CH_2CH_2O)_yCH_2CH_2O(CH_2CH(OH)CH_2)_w—$.

iii) Substituting preferred $R^2$ into $—CH_2CH(OR^2)CH_2—$ yields $—CH_2CH(OH)CH_2—$.

R' units are selected from the group consisting of hydrogen, $C_1$–$C_{22}$ alkyl, $C_3$–$C_{22}$ alkenyl, $C_7$–$C_{22}$ arylalkyl, $C_2$–$C_{22}$ hydroxyalkyl, $—(CH_2)_pCO_2M$, $—(CH_2)_qSO_3M$, $—CH(CH_2CO_2M)CO_2M$, $—(CH_2)_pPO_3M$, $—(R^1O)_mB$, $—C(O)R^3$, preferably hydrogen, $C_2$–$C_{22}$ hydroxyalkylene, benzyl, $C_1$–$C_{22}$ alkylene, $—(R^1O)_mB$, $—C(O)R^3$, $—(CH_2)_pCO_2M$, $—(CH_2)_qSO_3M$, $—CH(CH_2CO_2M)CO_2M$, more preferably $C_1$–$C_{22}$ alkylene, $—(R_1O)_xB$, $—C(O)R^3$, $—(CH_2)_pCO_2M$, $—(CH_2)_qSO_3M$, $—CH(CH_2CO_2M)CO_2M$, most preferably $C_1$–$C_{22}$ alkylene, $—(R^1O)_xB$, and $—C(O)R^3$. When no modification or substitution is made on a nitrogen then hydrogen atom will remain as the moiety representing R'. A most preferred R' unit is $(R^1O)_xB$.

R' units do not comprise hydrogen atom when the V, W or Z units are oxidized, that is the nitrogens are N-oxides. For example, the backbone chain or branching chains do not comprise units of the following structure:

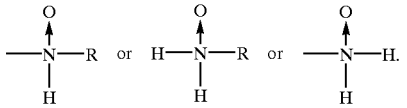

Additionally, R' units do not comprise carbonyl moieties directly bonded to a nitrogen atom when the V, W or Z units are oxidized, that is, the nitrogens are N-oxides. According to the present invention, the R' unit $—C(O)R^3$ moiety is not bonded to an N-oxide modified nitrogen, that is, there are no N-oxide amides having the structure

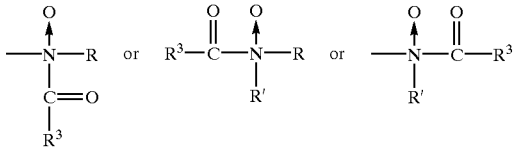

or combinations thereof.

B is hydrogen, $C_1$–$C_6$ alkyl, $—(CH_2)_qSO_3M$, $—(CH_2)_pCO_2M$, $—(CH_2)_q—(CHSO_3M)CH_2SO_3M$, $—(CH_2)_q(CHSO_2M)CH_2SO_3M$, $—(CH_2)_pPO_3M$, $—PO_3M$, preferably hydrogen, $—(CH_2)_qSO_3M$, $—(CH_2)_q(CHSO_3M)CH_2SO_3M$, $—(CH_2)_q—(CHSO_2M)CH_2SO_3M$, more preferably hydrogen or $—(CH_2)_qSO_3M$.

M is hydrogen or a water soluble cation in sufficient amount to satisfy charge balance. For example, a sodium cation equally satisfies $—(CH_2)_pCO_2M$, and $—(CH_2)_qSO_3M$, thereby resulting in $—(CH_2)_pCO_2Na$, and $—(CH_2)_qSO_3Na$ moieties. More than one monovalent cation, (sodium, potassium, etc.) can be combined to satisfy the required chemical charge balance. However, more than one anionic group may be charge balanced by a divalent cation, or more than one mono-valent cation may be necessary to satisfy the charge requirements of a poly-anionic radical. For example, a $—(CH_2)_pPO_3M$ moiety substituted with sodium atoms has the formula $—(CH_2)_pPO_3Na_3$. Divalent cations such as calcium ($Ca^{2+}$) or magnesium ($Mg^{2+}$) may be substituted for or combined with other suitable mono-valent water soluble cations. Preferred cations are sodium and potassium, more preferred is sodium.

X is a water soluble anion such as chlorine ($Cl^-$), bromine ($Br^-$) and iodine ($I^-$) or X can be any negatively charged radical such as sulfate ($SO_4^{2-}$) and methosulfate ($CH_3SO_3^-$).

The formula indices have the following values: p has the value from 1 to 6, q has the value from 0 to 6; r has the value 0 or 1; w has the value 0 or 1, x has the value from 1 to 100; y has the value from 0 to 100; z has the value 0 or 1; m has the value from 2 to 700, preferably from 4 to 400, n has the value from 0 to 350, preferably from 0 to 200; m+n has the value of at least 5.

Preferably x has a value lying in the range of from 1 to 20, preferably from 1 to 10.

The preferred amino-functional polymers of the present invention comprise polyamine backbones wherein less than 50% of the R groups comprise "oxy" R units, preferably less than 20% , more preferably less than 5%, most preferably the R units comprise no "oxy" R units.

The most preferred amino-functional polymers which comprise no "oxy" R units comprise polyamine backbones wherein less than 50% of the R groups comprise more than 3 carbon atoms. For example, ethylene, 1,2-propylene, and 1,3-propylene comprise 3 or less carbon atoms and are the preferred "hydrocarbyl" R units. That is when backbone R units are $C_2$–$C_{12}$ alkylene, preferred is $C_2$–$C_3$ alkylene, most preferred is ethylene.

The amino-functional polymers of the present invention comprise modified homogeneous and non-homogeneous polyamine backbones, wherein 100% or less of the —NH units are modified. For the purpose of the present invention the term "homogeneous polyamine backbone" is defined as a polyamine backbone having R units that are the same (i.e., all ethylene). However, this sameness definition does not exclude polyamines that comprise other extraneous units comprising the polymer backbone which are present due to an artifact of the chosen method of chemical synthesis. For example, it is known to those skilled in the art that ethanolamine may be used as an "initiator" in the synthesis of polyethyleneimines, therefore a sample of polyethyleneimine that comprises one hydroxyethyl moiety resulting from the polymerization "initiator" would be considered to comprise a homogeneous polyamine backbone for the purposes of the present invention. A polyamine backbone comprising all ethylene R units wherein no branching Y units are present is a homogeneous backbone. A polyamine backbone comprising all ethylene R units is a homogeneous backbone regardless of the degree of branching or the number of cyclic branches present.

For the purposes of the present invention the term "non-homogeneous polymer backbone" refers to polyamine backbones that are a composite of various R unit lengths and R unit types. For example, a non-homogeneous backbone comprises R units that are a mixture of ethylene and 1,2-propylene units. For the purposes of the present invention a mixture of "hydrocarbyl" and "oxy" R units is not necessary to provide a non-homogeneous backbone.

Preferred amino-functional polymers of the present invention comprise homogeneous polyamine backbones that are totally or partially substituted by polyethyleneoxy moieties, totally or partially quaternized amines, nitrogens totally or partially oxidized to N-oxides, and mixtures thereof. However, not all backbone amine nitrogens must be modified in the same manner, the choice of modification being left to the specific needs of the formulator. The degree of ethoxylation is also determined by the specific requirements of the formulator.

The preferred polyamines that comprise the backbone of the compounds of the present invention are generally polyalkyleneimines (PAI's), preferably polyethyleneimines (PEI's), or PEI's connected by moieties having longer R units than the parent PAI's or PEI's.

Preferred amine polymer backbones comprise R units that are $C_2$ alkylene (ethylene) units, also known as polyethylenimines (PEI's). Preferred PEI's have at least moderate branching, that is the ratio of m to n is less than 4:1, however PEI's having a ratio of m to n of 2:1 are most preferred. Preferred backbones, prior to modification have the general formula:

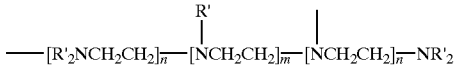

wherein R', m and n are the same as defined herein above. Preferred PEI's will have a molecular weight greater than 200 daltons.

The relative proportions of primary, secondary and tertiary amine units in the polyamine backbone, especially in the case of PEI's, will vary, depending on the manner of preparation. Each hydrogen atom attached to each nitrogen atom of the polyamine backbone chain represents a potential site for subsequent substitution, quaternization or oxidation.

These polyamines can be prepared, for example, by polymerizing ethyleneimine in the presence of a catalyst such as carbon dioxide, sodium bisulfite, sulfuric acid, hydrogen peroxide, hydrochloric acid, acetic acid, etc. Specific methods for preparing these polyamine backbones are disclosed in U.S. Pat. No. 2,182,306, Ulrich et al., issued Dec, 5, 1939; U.S. Pat. No. 3,033,746, Mayle et al., issued May 8, 1962; U.S. Pat. No. 2,208,095, Esselmann et al., issued Jul. 16, 1940; U.S. Pat. No. 2,806,839, Crowther, issued Sep. 17, 1957; and U.S. Pat. No. 2,553,696, Wilson, issued May 21, 1951; all herein incorporated by reference.

Examples of amino-functional polymers comprising PEI's, are illustrated in Formulas I–IV:

Formula I depicts an amino-functional polymer comprising a PEI backbone wherein all substitutable nitrogens are modified by replacement of hydrogen with a polyoxyalkyleneoxy unit, —$(CH_2CH_2O)H$, having the formula Formula I

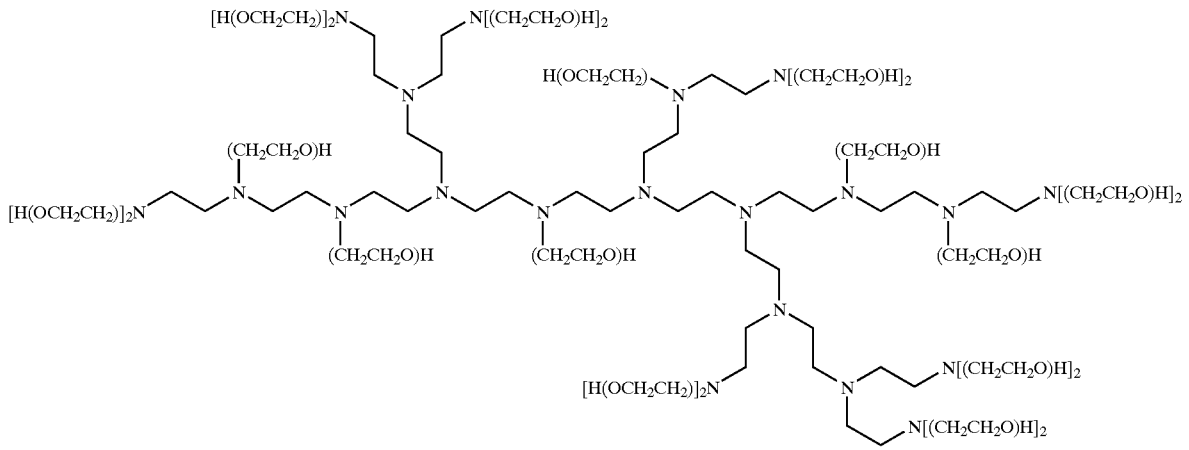

This is an example of an amino-functional polymer that is fully modified by one type of moiety.

Formula II depicts an amino-functional polymer comprising a PEI backbone wherein all substitutable primary amine nitrogens are modified by replacement of hydrogen with a polyoxyalkyleneoxy unit, —$(CH_2CH_2O)_2H$, the molecule is then modified by subsequent oxidation of all oxidizable primary and secondary nitrogens to N-oxides, said polymer having the formula Formula II

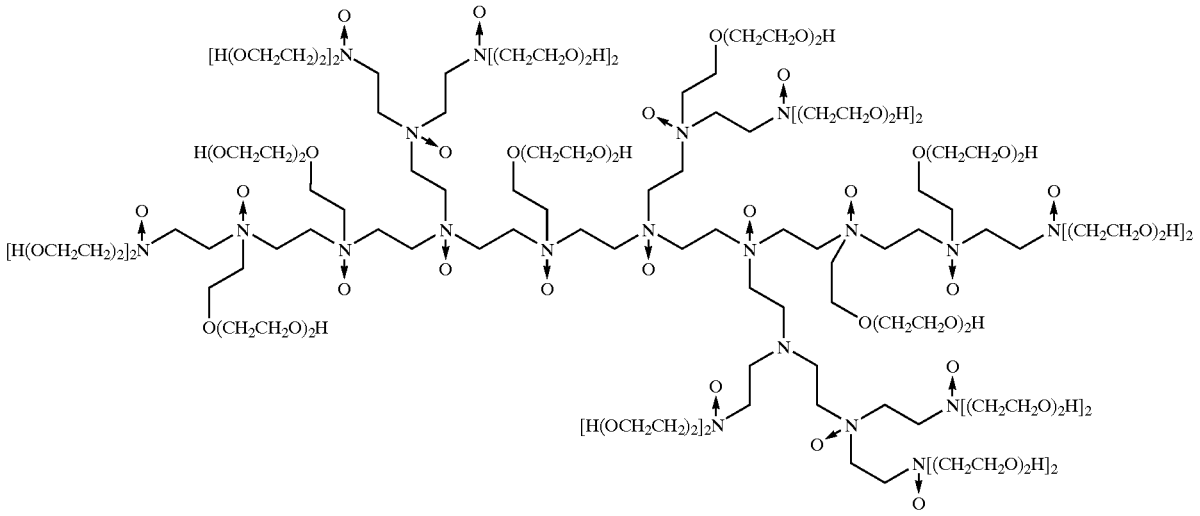

Formula III depicts an amino-functional polymer comprising a PEI backbone wherein all backbone hydrogen atoms are substituted and some backbone amine units are quaternized. The substituents are polyoxyalkyleneoxy units, —$(CH_2CH_2O)_7H$, or methyl groups. The modified PEI has the formula Formula III

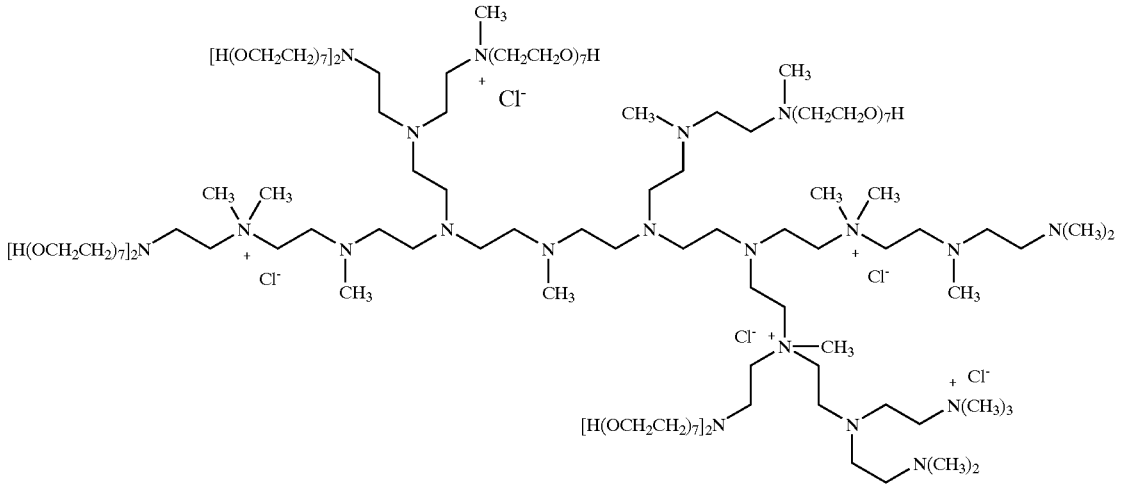

Formula IV depicts an amino-functional polymer comprising a PEI backbone wherein the backbone nitrogens are modified by substitution (i.e. by —$(CH_2CH_2O)_3H$ or methyl), quaternized, oxidized to N-oxides or combinations thereof. The resulting polymer has the formula Formula IV

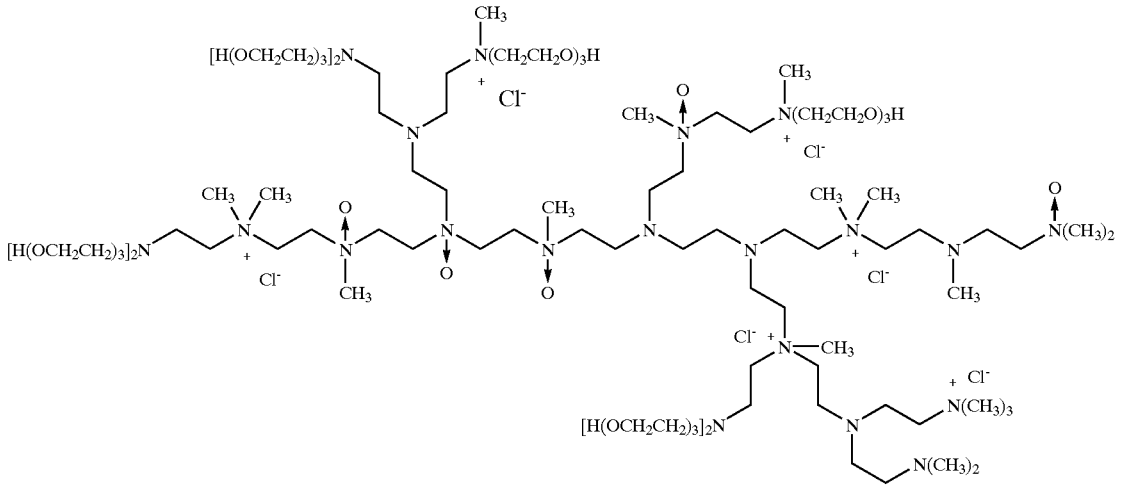

In the above examples, not all nitrogens of a unit class comprise the same modification. The present invention allows the formulator to have a portion of the secondary amine nitrogens ethoxylated while having other secondary amine nitrogens oxidized to N-oxides. This also applies to the primary amine nitrogens, in that the formulator may choose to modify all or a portion of the primary amine nitrogens with one or more substituents prior to oxidation or quaternization. Any possible combination of R' groups can be substituted on the primary and secondary amine nitrogens, except for the restrictions described herein above.

Commercially available amino-functional polymer suitable for use herein are poly(ethyleneimine) with a MW 1200, hydroxyethylated poly(ethyleneimine) from Polysciences, with a MW 2000, and 80% hydroxyethylated poly(ethyleneimine) from Aldrich.

A typical amount of amino-functional polymer to be employed in the composition of the invention is preferably up to 90% by weight, preferably from 0.01% to 50% active by weight, more preferably from 0.1% to 20% by weight and most preferably from 0.5% to 15% by weight of the composition.

Crystal Growth Inhibitor

A crystal growth inhibitor (CGI) is an essential component of the invention. By "crystal growth inhibitor", it is meant a compound that reduces the rate of formation of inorganic microcrystals, thereby reducing the size and/or the amount of such micro-crystals at the fabric surface.

The suitable CGI for use herein can be defined by the following test procedure, so called crystal growth inhibition test measurement.

Crystal Growth Inhibition Test Measurement

The ability for a compound to inhibit crystal growth can be assessed by evaluating the impact in vitro on the growth rate of inorganic micro-crystals. For this purpose, a system developed by G. H. Nancollas in 1964, described in Nancollas, G. H and Koutsoukos, P. G. "Calcium Phosphate Nucleation and Growth in solution." *Prog. Crystal Growth Charact.* 3, 77–102 (1980) can be used. This system consists of measuring the growth rate of calcium phosphate crystals seeded with hydroxyapatite ($[Ca_5(PO_4)_3OH]$ or HAP) in the presence of $CaCl_2$ and $NaH_2PO_4$. Calcium phosphate growth liberates protons that can be titrated with a strong base. The amount of base needed to keep the pH constant over the crystal growth enables persons skilled in the art to measure the crystal growth rate directly as well as to determine the effects of potential crystal growth rate inhibitors. A typical plot of such an experiment is given below:

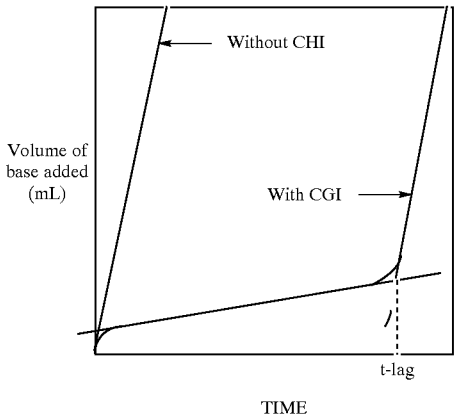

The observed t-lag value defines the efficiency of a compound to inhibit the growth of calcium phosphate crystals; wherein the higher the t-lag, the better the CGI.

The following procedure can be used to build the plot given above experimentally:

Place 350 mL of distilled water (distilled twice), 35 mL of KCl 2.1M, 50 mL of $CaCl_2$ 0.0175M and 50 mL of $KH_2PO_4$ 0.01M in a reaction vessel. Insert a glass pH electrode and a standard calomel reference electrode connected to an auto-titrator. Bubble nitrogen gas and stabilize the temperature of the reaction mixture to 37° C. When temperature and pH are stabilized, add the CGI candidate at the concentration to be tested (e.g. $1.10^{-6}$M). Titrate to pH 7.4 with KOH 0.05M. Then seed the reaction mixture with 5 mL of hydroxyapatite slurry $[Ca_5(PO_4)OH]$.

The hydroxyapatite slurry is prepared as follows:

100 gr of Bio-Gel® HTP hydroxyapatite powder is dispersed in 1 L of distilled water. The pH of the resulting slurry is lowered to 2.5 by dropwise addition of HCl 6N. This is then heated to boiling and refluxed while stirring for seven days in a 2 L round-bottom flask connected to a condenser. After cooling, to room temperature, pH is adjusted to 12.0 by dropwise addition of 50% NaOH and the slurry is refluxed for another seven days as before. The slurry is allowed to settle for to days and the supernatant is suctioned off. The flask is refilled with 1.5 L of distilled water, stirred vigorously, an allowed to settle again for two days. A total of seven rinses as described above are performed. The pH is adjusted to 7.0 by dropwise addition of HCl 2N while stirring vigorously. The resulting slurry is stored at 37° C. for eleven months.

The plot shown above is obtained by recording the amount of base added over time to maintain the pH of the reaction medium. T-lag for a particular crystal growth inhibitor is determined graphically as described in the figure above.

The crystal growth inhibitors to be used for the purpose of this invention have a t-lag of at least 10 minutes at a concentration of $1.10^{-6}$M, preferably at least 20 minutes, most preferably at least 50 minutes.

Still another suitable method for determining the crystal growth inhibition property of the selected component which is comparable to the T-lag method is by a visual grading. The method is as follows:

A multicycle laundry test is performed over several (e.g. 10) cycles of repeated washing and tumble drying. The conditions used are representative for the desired geographical region (e.g. domestic washing machine used, detergent used, rinse added product use, water hardness, clothing articles washed etc.). At least two test legs are run in parallel, including the composition of the invention and a separate reference leg. After the required number of washing cycles have been performed the test garments (articles of clothing) are taken for comparison by expert graders under controlled lighting conditions. The visual grading is a better/worse comparison of the visible crystalline residue on the surface of the test garments, comparing the test leg to the reference leg. Dark coloured, knitted cotton articles are most suitable for this comparison.

In addition, the crystal growth inhibitors, differentiate themselves from the chelating agents by their low binding affinity for copper defined by its Log K, i.e the ML/M.L Log K at 25 C., 0.1 ionic strength, of the CGI is of less than 15, preferably less than 12.

Preferably, the CGI for use in the present invention are selected from carboxylic compounds, organic monophosphonic acids, organic diphosphonic acids, and mixtures thereof.

Carboxylic Compounds

Typical of carboxylic compound for use herein are the carboxylic compounds selected from glycolic acid, phytic acid, monomeric polycarboxylic acids, homo or copolymeric polycarboxylic acids or their salts in which the polycarboxylic acid comprises at least two carboxylic radicals separated from each other by not more than two carbon atoms.

When utilised in salt form, alkali metals, such as sodium, potassium and lithium, or alkanolammonium salts are preferred.

Organic detergent CGIs suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate CGI can generally be added to the composition in acid form, but can also be added in the form of a neutralised salt. When utilized in salt form, alkali metals, such as sodium, potassium, and lithium, or alkanolammonium salts are preferred.

Included among the polycarboxylate CGIs are a variety of categories of useful materials. One important category of polycarboxylate CGIs encompasses the ether polycarboxylates, including oxydisuccinate, as disclosed in U.S. Pat. Nos. 3,128,287 and 3,635,830. See also "TMS/TDS" CGIs of U.S. Pat. No. 4,663,071. Suitable ether polycarboxylates also include cyclic compounds, particularly alicyclic compounds, such as those described in U.S. Pat. Nos. 3,923,679; 3,835,163; 4,158,635; 4,120,874 and 4,102,903.

Other useful CGI include the ether hydroxypolycarboxylates, polyacrylate polymers, copolymers of maleic anhydride with ethylene or vinyl methyl ether, or acrylic acid, 1,3,5-trihydroxy benzene-2,4,6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

The molecular weight for these polymers and copolymers is preferably below 100,000, most preferably between 500 and 50,000.

Commercially available polymers, suitable for use herein, which prevent the precipitation of the salts of the buffering component upon dilution of the composition in water are the polyacrylate polymers sold under the tradename Good-Rite® from BF Goodrich, Acrysol® from Rohm & Haas, Sokalan® from BASF, Norasol® from Norso Haas. Preferred commercially available polymers are the polyacrylate polymers, especially the Norasol® polyacrylate polymers and more preferred are the polyacrylate polymer Norasol® 410N (MW 10,000) and the polyacrylate polymer modified with aminophosphonic groups Norasol® 440N (MW 4000) and its corresponding acid form Norasol® QR 784 (MW 4000) from Norso-Haas. Citrates, e.g., citric acid and soluble salts thereof (particularly sodium salt), are polycarboxylate CGI suitable for use herein.

Also suitable in the compositions containing the present invention are the 3,3-dicarboxy-4-oxa-1,6-hexanedioates and the related compounds disclosed in U.S. Pat. No. 4,566,984. Useful succinic acid CGI include the $C_5$–$C_{20}$ alkyl and alkenyl succinic acids and salts thereof. A particularly preferred compound of this type is dodecenylsuccinic acid. Specific examples of succinate CGIs include: laurylsuccinate, myristylsuccinate, palmitylsuccinate, 2-dodecenylsuccinate (preferred), 2-pentadecenylsuccinate, and the like. Laurylsuccinates are the preferred CGIs of this group, and are described in EP 0,200,263.

Other suitable polycarboxylates are disclosed in U.S. Pat. No. 4,144,226 and in U.S. Pat. No. 3,308,067. See also U.S. Pat. No. 3,723,322.

Organic Monophosphonic Acid

Organo monophosphonic acid or one of its salts or complexes is also suitable for use herein as a CGI.

By organo monophosphonic acid it is meant herein an organo monophosphonic acid which does not contain nitrogen as part of its chemical structure. This definition therefore excludes the organo aminophosphonates, which however may be included in compositions of the invention as heavy metal ion sequestrants.

The organo monophosphonic acid component may be present in its acid form or in the form of one of its salts or complexes with a suitable counter cation. Preferably any salts/complexes are water soluble, with the alkali metal and alkaline earth metal salts/complexes being especially preferred.

A prefered organo monophosphonic acid is 2-phosphonobutane-1,2,4-tricarboxylic acid commercially available from Bayer under the tradename of Bayhibit.

Organodiphosphonic Acid

Organo diphosphonic acid or one of its salts or complexes is also suitable for use herein as a CGI.

By organo diphosphonic acid it is meant herein an organo diphosphonic acid which does not contain nitrogen as part of its chemical structure. This definition therefore excludes the organo aminophosphonates, which however may be included in compositions of the invention as heavy metal ion sequestrants.

The organo diphosphonic acid component may be present in its acid form or in the form of one of its salts or complexes with a suitable counter cation. Preferably any salts/complexes are water soluble, with the alkali metal and alkaline earth metal salts/complexes being especially preferred.

The organo diphosphonic acid is preferably a $C_1$–$C_4$ diphosphonic acid and more preferably a $C_2$ diphosphonic acid selected from ethylene diphosphonic acid, α-hydroxy-2 phenyl ethyl diphosphonic acid, methylene diphosphonic acid, vinylidene 1,1 diphosphonic acid, 1,2 dihydroxyethane 1,1 diphosphonic acid and hydroxy-ethane 1,1 diphosphonic acid and any salts thereof and mixtures thereof.

A most preferred organo diphosphonic acid is hydroxyethane 1,1 diphosphonic acid (HEDP).

Among the above described classes of CGI, preferred classes for use herein are the class of organic monophosphonic acids and/or organic diphosphonic acids.

For the purpose of the invention, when the CGI is selected from carboxylic acid, organic diphosphonic acid, and mixtures thereof, the CGI is present at a level of less than 1%, preferably from 0.005% to 0.5%, more preferably from 0.05% to 0.50%, most preferably from 0.1% to 0.2% by weight of the composition.

Typical levels for CGI components other than carboxylic acid, organic diphosphonic acid, and mixtures thereof, like organo monophosphonic acid, are in amount of less than 10%, more preferably from 0.005% to 0.50%, most preferably from 0.1% to 0.2% by weight of the composition.

Preferably for the purpose of the invention, stabilisation of the polyamino-functional polymer containing composition are best stabilised where a weight ratio of said CGI to said polymer is of from 0.005:1 to 0.5:1, preferably from 0.01:1 to 0.1:1 is present.

The composition of the invention can be employed in stand alone product including pre- or post-wash additives. It can also be employed. It can also be used in fully-formulated compositions including laundry compositions as well as rinse added fabric softener compositions and dryer added compositions (e.g. sheets) which provide softening and/or antistatic benefits, and rinse added compositions.

The composition may comprises optional ingredients such as a dye fixing agent, a fabric softener compound and further optional ingredient.

Dye Fixing Agent

The composition of the invention may optionally comprise a dye fixing agent. Dye fixing agents, or "fixatives", are well-known, commercially available materials which are designed to improve the appearance of dyed fabrics by minimizing the loss of dye from fabrics due to washing. Not included within this definition are components which are fabric softeners or those described hereinbefore as amino-functional polymers, Many dye fixing agents are cationic, and are based on various quaternized or otherwise cationically charged organic nitrogen compounds. Cationic fixatives are available under various trade names from several suppliers. Representative examples include: CROSCOLOR PMF (July 1981, Code No. 7894) and CROSCOLOR NOFF (January 1988, Code No. 8544) from Crosfield; INDOSOL E-50 (Feb. 27, 1984, Ref. No. 6008.35.84; polyethyleneamine-based) from Sandoz; SANDOFIX TPS, which is also available from Sandoz and is a preferred polycationic fixative for use herein and SANDOFIX SWE (cationic resinous compound), REWIN SRF, REWIN SRF-O and REWIN DWR from CHT-Beitlich GMBH, Tinofix® ECO, Tinofix® FRD and Solfin® available from Ciba-Geigy.

Other cationic dye fixing agents are described in "After-treatments for improving the fastness of dyes on textile fibres" by Christopher C. Cook (REV. PROG. COLORATION Vol. 12, 1982). Dye fixing agents suitable for use in the present invention are ammonium compounds such as fatty acid—diamine condensates e.g. the hydrochloride, acetate, metosulphate and benzyl hydrochloride of oleyidiethyl aminoethylamide, oleylmethyldiethylenediaminemethosulphate, monostearyl-ethylene diaminotrimethylammonium methosulphate and oxidized products of tertiary amines; derivatives of polymeric alkyldiamines, polyamine-cyanuric chloride condensates and aminated glycerol dichlorohydrins.

A typical amount of the dye fixing agent to be employed in the composition of the invention is preferably up 90% by weight, preferably up to 50% by weight, more preferably from 0.001% to 10% by weight, most preferably from 0.5% to 5% active by weight of the composition.

The composition of the invention may also be formulated as a fabric softening composition. Accordingly, when formulated as a softening composition, it will comprises a fabric softening compound.

Fabric Softening Compound

Typical levels of incorporation of the softening compound in the softening composition are of from 1% to 80% by weight, preferably from 5% to 75%, more preferably from 15% to 70%, and even more preferably from 19% to 65%, by weight of the composition.

The fabric softener compound is preferably selected from a cationic, nonionic, amphoteric or anionic fabric softening component. Typical of the cationic softening components are the quaternary ammonium compounds or amine precursors thereof as defined hereinafter.

A)—Quaternary Ammonium Fabric Softening Active Compound (1) Preferred quaternary ammonium fabric softening active compound have the formula

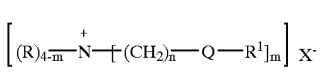

(1)

or the formula:

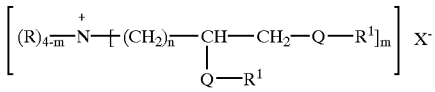

(2)

wherein Q is a carbonyl unit having the formula:

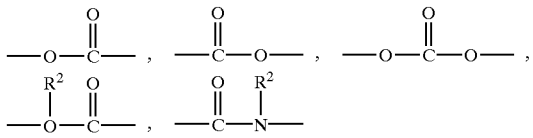

each R unit is independently hydrogen, $C_1$–$C_6$ alkyl, $C_1$–$C_6$ hydroxyalkyl, and mixtures thereof, preferably methyl or hydroxy alkyl; each $R^1$ unit is independently linear or branched $C_{11}$–$C_{22}$ alkyl, linear or branched $C_{11}$–$C_{22}$ alkenyl, and mixtures thereof, $R^2$ is hydrogen, $C_1$–$C_4$ alkyl, $C_1$–$C_4$ hydroxyalkyl, and mixtures thereof; X is an anion which is compatible with fabric softener actives and adjunct ingredients; the index m is from 1 to 4, preferably 2; the index n is from 1 to 4, preferably 2.

An example of a preferred fabric softener active is a mixture of quaternized amines having the formula:

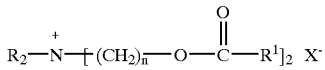

wherein R is preferably methyl; $R^1$ is a linear or branched alkyl or alkenyl chain comprising at least 11 atoms, preferably at least 15 atoms. In the above fabric softener example, the unit $—O_2CR^1$ represents a fatty acyl unit which is typically derived from a triglyceride source. The triglyceride source is preferably derived from tallow, partially hydrogenated tallow, lard, partially hydrogenated lard, vegetable oils and/or partially hydrogenated vegetable oils, such as, canola oil, safflower oil, peanut oil, sunflower oil, corn oil, soybean oil, tall oil, rice bran oil, etc. and mixtures of these oils.

The preferred fabric softening actives of the present invention are the Diester and/or Diamide Quaternary Ammonium (DEQA) compounds, the diesters and diamides having the formula:

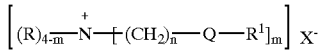

wherein R, $R^1$, X, and n are the same as defined herein above for formulas (1) and (2), and Q has the formula:

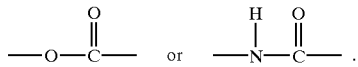

These preferred fabric softening actives are formed from the reaction of an amine with a fatty acyl unit to form an amine intermediate having the formula:

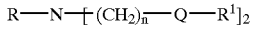

wherein R is preferably methyl, Q and $R^1$ are as defined herein before; followed by quaternization to the final softener active.

Non-limiting examples of preferred amines which are used to form the DEQA fabric softening actives according to the present invention include methyl bis(2-hydroxyethyl) amine having the formula:

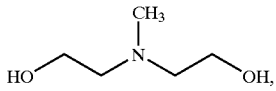

methyl bis(2-hydroxypropyl)amine having the formula:

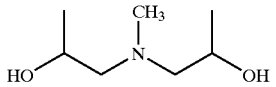

methyl (3-aminopropyl) (2-hydroxyethyl)amine having the formula:

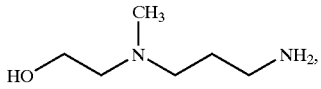

methyl bis(2-aminoethyl)amine having the formula:

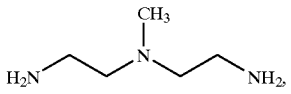

triethanol amine having the formula:

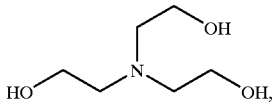

di(2-aminoethyl) ethanolamine having the formula:

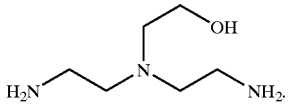

The counterion, $X^{(-)}$ above, can be any softener-compatible anion, preferably the anion of a strong acid, for example, chloride, bromide, methylsulfate, ethylsulfate, sulfate, nitrate and the like, more preferably chloride or methyl sulfate. The anion can also, but less preferably, carry a double charge in which case $X^{(-)}$ represents half a group.

Tallow and canola oil are convenient and inexpensive sources of fatty acyl units which are suitable for use in the present invention as $R^1$ units. The following are non-limiting examples of quaternary ammonium compounds suitable for use in the compositions of the present invention. The term "tallowyl" as used herein below indicates the $R^1$ unit is derived from a tallow triglyceride source and is a mixture of fatty acyl units. Likewise, the use of the term canolyl refers to a mixture of fatty acyl units derived from canola oil.

TABLE II

Fabric Softener Actives

N,N-di(tallowyl-oxy-ethyl)-N,N-dimethyl ammonium chloride;

N,N-di(canolyl-oxy-ethyl)-N,N-dimethyl ammonium chloride;

N,N-di(tallowyl-oxy-ethyl)-N-methyl,N-(2-hydroxyethyl) ammonium chloride;

N,N-di(canolyl-oxy-ethyl)-N-methyl,N-(2-hydroxyethyl) ammonium chloride;

N,N-di(2-tallowyloxy-2-oxo-ethyl)-N,N-dimethyl ammonium chloride;

N,N-di(2-canolyloxy-2-oxo-ethyl)-N,N-dimethyl ammonium chloride

N,N-di(2-tallowyloxyethylcarbonyloxyethyl)-N,N-dimethyl ammonium chloride;

N,N-di(2-canolyloxyethylcarbonyloxyethyl)-N,N-dimethyl ammonium chloride;

N-(2-tallowoyloxy-2-ethyl)-N-(2-tallowyloxy-2-oxo-ethyl)-N,N-dimethyl ammonium chloride;

N-(2-canolyloxy-2-ethyl)-N-(2-canolyloxy-2-oxo-ethyl)-N,N-dimethyl ammonium chloride;

N,N,N-tri(tallowyl-oxy-ethyl)-N-methyl ammonium chloride;

N,N,N-tricanolyl-oxy-ethyl)-N-methyl ammonium chloride;

N-(2-tallowyloxy-2-oxoethyl)-N-(tallowyl)-N,N-dimethyl ammonium chloride;

N-(2-canolyloxy-2-oxoethyl)-N-(canolyl)-N,N-dimethyl ammonium chloride;

1,2-ditallowyloxy-3-N,N,N-trimethylammoniopropane chloride; and 1,2-dicanolyloxy-3-N,N,N-trimethylammoniopropane chloride;

and mixtures of the above actives.

Other examples of quaternay ammoniun softening compounds are methylbis(tallowamidoethyl)(2-hydroxyethyl) ammonium methylsulfate and methylbis(hydrogenated tallowamidoethyl)(2-hydroxyethyl)ammonium methylsulfate; these materials are available from Witco Chemical Company under the trade names Varisoft® 222 and Varisoft® 110, respectively.

Particularly preferred is N,N-di(tallowoyl-oxy-ethyl)-N,N-dimethyl ammonium chloride, where the tallow chains are at least partially unsaturated.

The level of unsaturation contained within the tallow, canola, or other fatty acyl unit chain can be measured by the Iodine Value (IV) of the corresponding fatty acid, which in the present case should preferably be in the range of from 5 to 100 with two categories of compounds being distinguished, having a IV below or above 25.

Indeed, for compounds having the formula:

$$\left[(R)_{4-m}\overset{+}{N}\text{—}(CH_2)_n\text{—}Q\text{—}R^1]_m\right] X^-$$

derived from tallow fatty acids, when the Iodine Value is from 5 to 25, preferably 15 to 20, it has been found that a cis/trans isomer weight ratio greater than about 30/70, preferably greater than about 50/50 and more preferably greater than about 70/30 provides optimal concentrability. For compounds of this type made from tallow fatty acids having a Iodine Value of above 25, the ratio of cis to trans isomers has been found to be less critical unless very high concentrations are needed.

Other suitable examples of fabric softener actives are derived from fatty acyl groups wherein the terms "tallowyl" and "canolyl" in the above examples are replaced by the terms "cocoyl, palmyl, lauryl, oleyl, ricinoleyl, stearyl, palmityl," which correspond to the triglyceride source from which the fatty acyl units are derived. These alternative fatty acyl sources can comprise either fully saturated, or preferably at least partly unsaturated chains.

As described herein before, R units are preferably methyl, however, suitable fabric softener actives are described by replacing the term "methyl" in the above examples in Table II with the units "ethyl, ethoxy, propyl, propoxy, isopropyl, butyl, isobutyl and t-butyl".

The counter ion, X, in the examples of Table II can be suitably replaced by bromide, methylsulfate, formate, sulfate, nitrate, and mixtures thereof. In fact, the anion, X, is merely present as a counterion of the positively charged quaternary ammonium compounds. The scope of this invention is not considered limited to any particular anion.

For the preceding ester fabric softening agents, the pH of the compositions herein is an important parameter of the present invention. Indeed, it influences the stability of the quaternary ammonium or amine precursors compounds, especially in prolonged storage conditions.

The pH, as defined in the present context, is measured in the neat compositions at 20° C. While these compositions are operable at pH of less than about 6.0, for optimum hydrolytic stability of these compositions, the neat pH, measured in the above-mentioned conditions, must preferably be in the range of from about 2.0 to about 5, preferably in the range of 2.5 to 4.5, preferably about 2.5 to about 3.5. The pH of these compositions herein can be regulated by the addition of a Bronsted acid.

Examples of suitable acids include the inorganic mineral acids, carboxylic acids, in particular the low molecular weight ($C_1$–$C_5$) carboxylic acids, and alkylsulfonic acids. Suitable inorganic acids include HCl, $H_2SO_4$, $HNO_3$ and $H_3PO_4$. Suitable organic acids include formic, acetic, citric, methylsulfonic and ethylsulfonic acid. Preferred acids are citric, hydrochloric, phosphoric, formic, methylsulfonic acid, and benzoic acids.

As used herein, when the diester is specified, it will include the monoester that is normally present in manufacture. For softening, under no/low detergent carry-over laundry conditions the percentage of monoester should be as low as possible, preferably no more than about 2.5%. However, under high detergent carry-over conditions, some monoester is preferred.

The overall ratios of diester to monoester are from about 100:1 to about 2:1, preferably from about 50:1 to about 5:1, more preferably from about 13:1 to about 8:1. Under high detergent carry-over conditions, the di/monoester ratio is preferably about 11:1. The level of monoester present can be controlled in the manufacturing of the softener compound.

Mixtures of actives of formula (1) and (2) may also be prepared.

2)—Still other suitable quaternary ammonium fabric softening compounds for use herein are cationic nitrogenous salts having two or more long chain acyclic aliphatic $C_8$–$C_{22}$ hydrocarbon groups or one said group and an arylalkyl group which can be used either alone or as part of a mixture are selected from the group consisting of:

(i) acyclic quaternary ammonium salts having the formula:

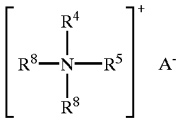

wherein $R^4$ is an acyclic aliphatic $C_8$–$C_{22}$ hydrocarbon group, $R^5$ is a $C_1$–$C_4$ saturated alkyl or hydroxyalkyl group, $R^8$ is selected from the group consisting of $R^4$ and $R^5$ groups, and $A^-$ is an anion defined as above;

(ii) diamino alkoxylated quaternary ammonium salts having the formula:

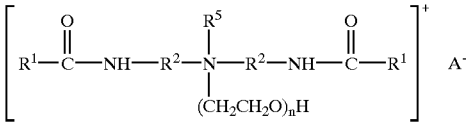

wherein n is equal to 1 to about 5, and $R^1$, $R^2$, $R^5$ and $A^-$ are as defined above;

(iii) mixtures thereof.

Examples of the above class cationic nitrogenous salts are the well-known dialkyldi methylammonium salts such as ditallowdimethylammonium chloride, ditallowdimethylammonium methylsulfate, di(hydrogenatedtallow) dimethylammonium chloride, distearyldimethylammonium chloride, dibehenyldimethylammonium chloride. Di(hydrogenatedtallow)di methylammonium chloride and ditallowdimethylammonium chloride are preferred. Examples of commercially available dialkyldimethyl ammonium salts usable in the present invention are di(hydrogenatedtallow)dimethylammonium chloride (trade name Adogen® 442), ditallowdimethylammonium chloride (trade name Adogen® 470, Praepagen® 3445), distearyl dimethylammonium chloride (trade name Arosurf® TA-100), all available from Witco Chemical Company. Dibehenyldimethylammonium chloride is sold under the trade name Kemamine Q-2802C by Humko Chemical Division of Witco Chemical Corporation.

Dimethylstearylbenzyl ammonium chloride is sold under the trade names Varisoft® SDC by Witco Chemical Company and Ammonyx® 490 by Onyx Chemical Company.

B)—Amine Fabric Softening Active Compound

Suitable amine fabric softening compounds for use herein, which may be in amine form or cationic form are selected from:

(i)—Reaction products of higher fatty acids with a polyamine selected from the group consisting of hydroxyalkylalkylenediamines and dialkylenetriamines and mixtures thereof. These reaction products are mixtures of several compounds in view of the multi-functional structure of the polyamines.

The preferred Component (i) is a nitrogenous compound selected from the group consisting of the reaction product mixtures or some selected components of the mixtures.

One preferred component (i) is a compound selected from the group consisting of substituted imidazoline compounds having the formula:

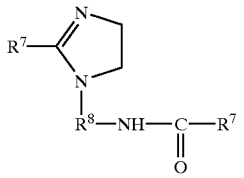

wherein $R^7$ is an acyclic aliphatic $C_{15}$–$C_{21}$ hydrocarbon group and $R^8$ is a divalent $C_1$–$C_3$ alkylene group.

Component (i) materials are commercially available as: Mazamide® 6, sold by Mazer Chemicals, or Ceranine® HC, sold by Sandoz Colors & Chemicals; stearic hydroxyethyl imidazoline sold under the trade names of Alkazine® ST by Alkaril Chemicals, Inc., or Schercozoline® S by Scher Chemicals, Inc.; N,N"-ditallowalkoyldiethylenetriamine; 1-tallowamidoethyl-2-tallowimidazoline (wherein in the preceding structure $R^1$ is an aliphatic $C_{15}$–$C_{17}$ hydrocarbon group and $R^8$ is a divalent ethylene group).

Certain of the Components (i) can also be first dispersed in a Bronsted acid dispersing aid having a pKa value of not greater than about 4; provided that the pH of the final composition is not greater than about 6. Some preferred dispersing aids are hydrochloric acid, phosphoric acid, or methylsulfonic acid.

Both N,N"-ditallowalkoyldiethylenetriamine and 1-tallow(amidoethyl)-2-tallowimidazoline are reaction products of tallow fatty acids and diethylenetriamine, and are precursors of the cationic fabric softening agent methyl-1-tallowamidoethyl-2-tallowimidazolinium methylsulfate (see "Cationic Surface Active Agents as Fabric Softeners," R. R. Egan, Journal of the American Oil Chemicals' Society, January 1978, pages 118–121). N,N"-ditallow alkoyidiethylenetriamine and 1-tallowamidoethyl-2-tallowimidazoline can be obtained from Witco Chemical Company as experimental chemicals. Methyl-1-tallowamidoethyl-2-tallowimidazolinium methylsulfate is sold by Witco Chemical Company under the tradename Varisoft® 475.

(ii)—softener having the formula:

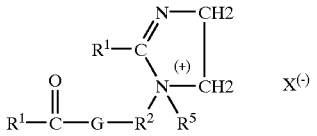

wherein each $R^2$ is a $C_{1-6}$ alkylene group, preferably an ethylene group; and G is an oxygen atom or an —NR— group; and each R, $R^1$, $R^2$ and $R^5$ have the definitions given above and $A^-$ has the definitions given above for $X^-$.

An example of Compound (ii) is 1-oleylamidoethyl-2-oleylimidazolinium chloride wherein $R^1$ is an acyclic aliphatic $C_{15}$–$C_{17}$ hydrocarbon group, $R^2$ is an ethylene group, G is a NH group, $R^5$ is a methyl group and $A^-$ is a chloride anion.

(iii)—softener having the formula:

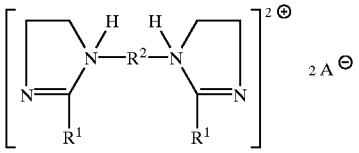

wherein R, $R^1$, $R^2$, and $A^-$ are defined as above.

An example of Compound (iii) is the compound having the formula:

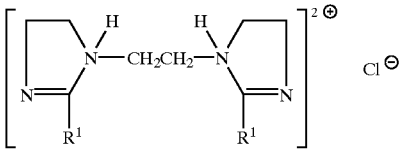

wherein $R^1$ is derived from oleic acid.

Additional fabric softening agents useful herein are described in U.S. Pat. No. 4,661,269, issued Apr. 28, 1987, in the names of Toan Trinh, Errol H. Wahl, Donald M. Swartley, and Ronald L. Hemingway; U.S. Pat. No. 4,439,335, Burns, issued Mar. 27, 1984; and in U.S. Pat. No. 3,861,870, Edwards and Diehl; U.S. Pat. No. 4,308,151, Cambre; U.S. Pat. No. 3,886,075, Bernardino; U.S. Pat. No. 4,233,164, Davis; U.S. Pat. No. 4,401,578, Verbruggen; U.S. Pat. No. 3,974,076, Wiersema and Rieke; U.S. Pat. No. 4,237,016, Rudkin, Clint, and Young; and European Patent Application publication No. 472,178, by Yamamura et al., all of said documents being incorporated herein by reference.

Of course, the term "softening active" can also encompass mixed softening active agents.

Preferred among the classes of softener compounds disclosed herein before are the diester or diamido quaternary ammonium fabric softening active compound (DEQA).

Fully formulated fabric softening compositions may contain, in addition to the hereinbefore described components, one or more of the following ingredients.

Optional Ingredients (A) Liquid Carrier

Another optional, but preferred, ingredient is a liquid carrier. The liquid carrier employed in the instant compositions is preferably at least primarily water due to its low cost, relative availability, safety, and environmental compatibility. The level of water in the liquid carrier is preferably at least about 50%, most preferably at least about 60%, by weight of the carrier. Mixtures of water and low molecular weight, e.g., <about 200, organic solvent, e.g., lower alcohols such as ethanol, propanol, isopropanol or butanol are useful as the carrier liquid. Low molecular weight alcohols include monohydric, dihydric (glycol, etc.) trihydric (glycerol, etc.), and higher polyhydric (polyols) alcohols.

(B)—Additional Solvents

The compositions of the present invention may comprise one or more solvents which provide increased ease of formulation. These ease of formulation solvents are all disclosed in WO 97/03169. This is particularly the case when formulating liquid, clear fabric softening compositions. When employed, the ease of formulation solvent system preferably comprises less than about 40%, preferably from about 10% to about 35%, more preferably from about 12% to about 25%, and even more preferably from about 14% to about 20%, by weight of the composition. The ease of formulation solvent is selected to minimize solvent odor impact in the composition and to provide a low viscosity to the final composition. For example, isopropyl alcohol is not very effective and has a strong odor. n-Propyl alcohol is more effective, but also has a distinct odor. Several butyl alcohols also have odors but can be used for effective clarity/stability, especially when used as part of a ease of formulation solvent system to minimize their odor. The alcohols are also selected for optimum low temperature stability, that is they are able to form compositions that are liquid with acceptable low viscosities and translucent, preferably clear, down to about 40° F. (about 4.4° C.) and are able to recover after storage down to about 20° F. (about minus 6.7° C.).

The suitability of any ease of formulation solvent for the formulation of the liquid, concentrated, preferably clear, fabric softener compositions herein with the requisite stability is surprisingly selective. Suitable solvents can be selected based upon their octanol/water partition coefficient (P) as defined in WO 97/03169.

The ease of formulation solvents herein are selected from those having a ClogP of from about 0.15 to about 0.64, preferably from about 0.25 to about 0.62, and more preferably from about 0.40 to about 0.60, said ease of formulation solvent preferably being at least somewhat asymmetric, and preferably having a melting, or solidification, point that allows it to be liquid at, or near room temperature. Solvents that have a low molecular weight and are biodegradable are also desirable for some purposes. The more assymetric solvents appear to be very desirable, whereas the highly symmetrical solvents such as 1,7-heptanediol, or 1,4-bis (hydroxymethyl)cyclohexane, which have a center of symmetry, appear to be unable to provide the essential clear compositions when used alone, even though their ClogP values fall in the preferred range.

The most preferred ease of formulation solvents can be identified by the appearance of the softener vesicles, as observed via cryogenic electron microscopy of the compositions that have been diluted to the concentration used in the rinse. These dilute compositions appear to have dispersions of fabric softener that exhibit a more unilamellar appearance than conventional fabric softener compositions. The closer to uni-lamellar the appearance, the better the compositions seem to perform. These compositions provide surprisingly good fabric softening as compared to similar compositions prepared in the conventional way with the same fabric softener active.

Operable ease of formulation solvents are disclosed and listed below which have ClogP values which fall within the requisite range. These include mono-ols, C6 diols, C7 diols, octanediol isomers, butanediol derivatives, trimethylpentanediol isomers, ethylmethylpentanediol isomers, propyl pentanediol isomers, dimethylhexanediol isomers, ethylhexanediol isomers, methylheptanediol isomers, octanediol isomers, nonanediol isomers, alkyl glyceryl ethers, di(hydroxy alkyl) ethers, and aryl glyceryl ethers, aromatic glyceryl ethers, alicyclic diols and derivatives, $C_3C_7$ diol alkoxylated derivatives, aromatic diols, and unsaturated diols. Particularly preferred ease of formulation solvents include hexanediols such as 1,2-Hexanediol and 2-Ethyl-1,3-hexanediol and pentanediols such as 2,2,4-Trimethyl-1,3-pentanediol.

(C)—Dispersibility Aids

Relatively concentrated compositions containing both saturated and unsaturated diester quaternary ammonium compounds can be prepared that are stable without the addition of concentration aids. However, the compositions of the present invention may require organic and/or inorganic concentration aids to go to even higher concentrations and/or to meet higher stability standards depending on the other ingredients. These concentration aids which typically can be viscosity modifiers may be needed, or preferred, for ensuring stability under extreme conditions when particular softener active levels are used. The surfactant concentration aids are typically selected from the group consisting of (1) single long chain alkyl cationic surfactants; (2) nonionic surfactants; (3) amine oxides; (4) fatty acids; and (5) mixtures thereof. These aids are described in WO 94/20597, specifically on page 14, line 12 to page 20, line 12, which is herein incorporated by reference.

When said dispersibility aids are present, the total level is from 2% to 25%, preferably from 3% to 17%, more preferably from 4% to 15%, and even more preferably from 5% to 13% by weight of the composition. These materials can either be added as part of the active softener raw material, (I), e.g., the mono-long chain alkyl cationic surfactant and/or the fatty acid which are reactants used to form the biodegradable fabric softener active as discussed hereinbefore, or added as a separate component. The total level of dispersibility aid includes any amount that may be present as part of component (I).

Inorganic viscosity/dispersibility control agents which can also act like or augment the effect of the surfactant concentration aids, include water-soluble, ionizable salts which can also optionally be incorporated into the compositions of the present invention. A wide variety of ionizable salts can be used. Examples of suitable salts are the halides of the Group IA and IIA metals of the Periodic Table of the Elements, e.g., calcium chloride, magnesium chloride, sodium chloride, potassium bromide, and lithium chloride. The ionizable salts are particularly useful during the process of mixing the ingredients to make the compositions herein, and later to obtain the desired viscosity. The amount of ionizable salts used depends on the amount of active ingredients used in the compositions and can be adjusted according to the desires of the formulator. Typical levels of salts used to control the composition viscosity are from about 20 to about 20,000 parts per million (ppm), preferably from about 20 to about 11,000 ppm, by weight of the composition.

Alkylene polyammonium salts can be incorporated into the composition to give viscosity control in addition to or in place of the water-soluble, ionizable salts above. In addition, these agents can act as scavengers, forming ion pairs with anionic detergent carried over from the main wash, in the rinse, and on the fabrics, and may improve softness performance. These agents may stabilize the viscosity over a broader range of temperature, especially at low temperatures, compared to the inorganic electrolytes.

Specific examples of alkylene polyammonium salts include I-lysine monohydrochloride and 1,5-diammonium 2-methyl pentane dihydrochloride.

(D)—Stabilizers

Stabilizers can be present in the compositions of the present invention. The term "stabilizer," as used herein, includes antioxidants and reductive agents. These agents are present at a level of from 0% to about 2%, preferably from about 0.01% to about 0.2%, more preferably from about 0.035% to about 0.1% for antioxidants, and more preferably from about 0.01% to about 0.2% for reductive agents. These assure good odor stability under long term storage conditions for the compositions and compounds stored in molten form. The use of antioxidants and reductive agent stabilizers is especially critical for low scent products (low perfume).

Examples of antioxidants that can be added to the compositions of this invention include a mixture of ascorbic acid, ascorbic palmitate, propyl gallate, available from Eastman Chemical Products, Inc., under the trade names Tenox® PG and Tenox S-1; a mixture of BHT (butylated hydroxytoluene), BHA (butylated hydroxyanisole), propyl gallate, and citric acid, available from Eastman Chemical Products, Inc., under the trade name Tenox-6; butylated hydroxytoluene, available from UOP Process Division under the trade name Sustane® BHT; tertiary butylhydroquinone, Eastman Chemical Products, Inc., as Tenox TBHQ; natural tocopherols, Eastman Chemical Products, Inc., as Tenox GT-1/GT-2; and butylated hydroxyanisole, Eastman Chemical Products, Inc., as BHA; long chain esters ($C_8$–$C_{22}$) of gallic acid, e.g., dodecyl gallate; Irganox® 1010; Irganox® 1035; Irganox® B 1171; Irganox® 1425; Irganox® 3114; Irganox® 3125; and mixtures thereof; preferably Irganox® 3125, Irganox® 1425, Irganox® 3114, and mixtures thereof; more preferably Irganox® 3125 alone. The chemical names and CAS numbers for some of the above stabilizers are listed in Table II below.

TABLE II

| Antioxidant | CAS No. | Chemical Name used in Code of Federal Regulations |
|---|---|---|
| Irganox ® 1010 | 6683-19-8 | Tetrakis (methylene(3,5-di-tert-butyl-4 hydroxyhydrocinnamate)) methane |
| Irganox ® 1035 | 41484-35-9 | Thiodiethylene bis(3,5-di-tert-butyl-4-hydroxyhydrocinnamate |
| Irganox ® 1098 | 23128-74-7 | N,N'-Hexamethylene bis(3,5-di-tert-butyl-4-hydroxyhydrocinnamamide |
| Irganox ® B | 31570-04-4 | |
| 1171 | 23128-74-7 | 1:1 Blend of Irganox ® 1098 and Irgafos ® 168 |
| Irganox ® 1425 | 65140-91-2 | Calcium bis(monoethyl(3,5-di-tert-butyl-4-hydroxybenzyl)phosphonate) |
| Irganox ® 3114 | 65140-91-2 | Calcium bis(monoethyl(3,5-di-tert-butyl-4-hydroxybenzyl)phosphonate) |
| Irganox ® 3125 | 34137-09-2 | 3,5-Di-tert-butyl-4-hydroxy-hydrocinnamic acid triester with 1,3,5-tris(2-hydroxyethyl)-S-triazine-2,4,6-(1H, 3H, 5H)-trione |
| Irgafos ® 168 | 31570-04-4 | Tris(2,4-di-tert-butyl-phenyl)phosphite |

Examples of reductive agents include sodium borohydride, hypophosphorous acid, Irgafos® 168, and mixtures thereof.

(E)—Soil Release Agent

Soil Release agents are desirably used in fabric softening compositions of the instant invention. Any polymeric soil release agent known to those skilled in the art can optionally be employed in the compositions of this invention. Polymeric soil release agents are characterized by having both hydrophilic segments, to hydrophilize the surface of hydrophobic fibers, such as polyester and nylon, and hydrophobic segments, to deposit upon hydrophobic fibers and remain adhered thereto through completion of washing and rinsing cycles and, thus, serve as an anchor for the hydrophilic segments. This can enable stains occurring subsequent to treatment with the soil release agent to be more easily cleaned in later washing procedures.

If utilized, soil release agents will generally comprise from about 0.01% to about 10.0%, by weight, of the detergent compositions herein, typically from about 0.1% to about 5%, preferably from about 0.2% to about 3.0%.

The following, all included herein by reference, describe soil release polymers suitable for use in the present invention. U.S. Pat. No. 3,959,230 Hays, issued May 25, 1976; U.S. Pat. No. 3,893,929 Basadur, issued Jul. 8, 1975; U.S. Pat. No. 4,000,093, Nicol, et al., issued Dec. 28, 1976; U.S. Pat. No. 4,702,857 Gosselink, issued Oct. 27, 1987; U.S. Pat. No. 4,968,451, Scheibel et al., issued November 6; U.S. Pat. No. 4,702,857, Gosselink, issued Oct. 27, 1987; U.S. Pat. No. 4,711,730, Gosselink et al., issued Dec. 8, 1987; U.S. Pat. No. 4,721,580, Gosselink, issued Jan. 26, 1988; U.S. Pat. No. 4,877,896, Maldonado et al., issued Oct. 31, 1989; U.S. Pat. No. 4,956,447, Gosselink et al., issued Sep. 11, 1990; U.S. Pat. No. 5,415,807 Gosselink et al., issued May 16, 1995; European Patent Application 0 219 048, published Apr. 22, 1987 by Kud, et al.

Further suitable soil release agents are described in U.S. Pat. No. 4,201,824, Violland et al.; U.S. Pat. No. 4,240,918 Lagasse et al.; U.S. Pat. No. 4,525,524 Tung et al.; U.S. Pat. No. 4,579,681, Ruppert et al.; U.S. Pat. Nos. 4,240,918; 4,787,989; 4,525,524; EP 279,134 A, 1988, to Rhone-Poulenc Chemie; EP 457,205 A to BASF (1991); and DE 2,335,044 to Unilever N. V., 1974 all incorporated herein by reference.

Commercially available soil release agents include the METOLOSE SM100, METOLOSE SM200 manufactured by Shin-etsu Kagaku Kogyo K. K., SOKALAN type of material, e.g., SOKALAN HP-22, available from BASF (Germany), ZELCON 5126 (from Dupont) and MILEASE T (from ICI).

(F)—Bactericides

Examples of bactericides used in the compositions of this invention include glutaraldehyde, formaldehyde, 2-bromo-2-nitro-propane-1,3-diol sold by Inolex Chemicals, located in Philadelphia, Pa., under the trade name Bronopol®, and a mixture of 5-chloro-2-methyl-4-isothiazoline-3-one and 2-methyl4-isothiazoline-3-one sold by Rohm and Haas Company under the trade name Kathon 1 to 1,000 ppm by weight of the agent.

(G)—Perfume

The present invention can contain a perfume. Suitable perfumes are disclosed in U.S. Pat. No. 5,500,138, said patent being incorporated herein by reference.

As used herein, perfume includes fragrant substance or mixture of substances including natural (i.e., obtained by extraction of flowers, herbs, leaves, roots, barks, wood, blossoms or plants), artificial (i.e., a mixture of different nature oils or oil constituents) and synthetic (i.e., synthetically produced) odoriferous substances. Such materials are often accompanied by auxiliary materials, such as fixatives, extenders, stabilizers and solvents. These auxiliaries are also included within the meaning of "perfume", as used herein. Typically, perfumes are complex mixtures of a plurality of organic compounds.

The range of the natural raw substances can embrace not only readily-volatile, but also moderately-volatile and slightly-volatile components and that of the synthetics can include representatives from practically all classes of fragrant substances, as will be evident from the following illustrative compilation: natural products, such as tree moss absolute, basil oil, citrus fruit oils (such as bergamot oil, mandarin oil, etc.), mastix absolute, myrtle oil, palmarosa oil, patchouli oil, petitgrain oil Paraguay, wormwood oil, alcohols, such as farnesol, geraniol, linalool, nerol, phenylethyl alcohol, rhodinol, cinnamic alcohol, aldehydes, such as citral, Helional™, alpha-hexyl-cinnamaldehyde, hydroxycitronellal, Lilial™ (p-tert-butyl-alpha-methyidihydrocinnamaldehyde), methyinonylacetaldehyde, ketones, such as allylionone, alpha-ionone, beta-ionone, isoraldein (isomethyl-alpha-ionone), methylionone, esters, such as allyl phenoxyacetate, benzyl salicylate, cinnamyl propionate, citronellyl acetate, citronellyl ethoxolate, decyl acetate, dimethylbenzylcarbinyl acetate, dimethylbenzylcarbinyl butyrate, ethyl acetoacetate, ethyl acetylacetate, hexenyl isobutyrate, linalyl acetate, methyl dihydrojasmonate, styrallyl acetate, vetiveryl acetate, etc., lactones, such as gamma-undecalactone, various components often used in perfumery, such as musk ketone, indole, p-menthane-8-thiol-3-one, and methyl-eugenol. Likewise, any conventional fragrant acetal or ketal known in the art can be added to the present composition as an optional component of the conventionally formulated perfume (c). Such conventional fragrant acetals and ketals include the well-known methyl and ethyl acetals and ketals, as well as acetals or ketals based on benzaldehyde, those comprising phenylethyl moieties, or more recently developed specialties such as those described in a United States Patent entitled "Acetals and Ketals of Oxo-Tetralins and Oxo-Indanes", see U.S. Pat. No. 5,084,440, issued Jan. 28, 1992, assigned to Givaudan Corp. Of course, other recent synthetic specialties can be included in the perfume compositions for fully-formulated fabric softening compositions. These include the enol ethers of alkyl-substituted oxo-tetralins and oxo-indanes as described in U.S. Pat. No. 5,332,725, Jul. 26, 1994, assigned to Givaudan; or Schiff Bases as described in U.S. Pat. No. 5,264,615, Dec. 9, 1991, assigned to Givaudan.

The perfumes useful in the present invention compositions are substantially free of halogenated materials and nitromusks.

Perfume can be present at a level of from 0% to 10%, preferably from 0.1% to 5%, and more preferably from 0.2% to 3%, by weight of the finished composition. Fabric softener compositions of the present invention provide improved fabric perfume deposition.

(H)—Enzyme

The compositions and processes herein can optionally employ one or more enzymes such as lipases, proteases, cellulase, amylases and peroxidases. A preferred enzyme for use herein is a cellulase enzyme. Indeed, this type of enzyme will further provide a color care benefit to the treated fabric. Cellulases usable herein include both bacterial and fungal types, preferably having a pH optimum between 5 and 9.5. U.S. Pat. No. 4,435,307 discloses suitable fungal cellulases from *Humicola insolens* or Humicola strain DSM1800 or a cellulase 212-producing fungus belonging to the genus Aeromonas, and cellulase extracted from the hepatopancreas of a marine mollusk, *Dolabella Auricula* Solander. Suitable cellulases are also disclosed in GB-A-2.075.028; GB-A-2.095.275 and DE-OS-2.247.832. CAREZYME® and CELLUZYME® (Novo) are especially useful. Other suitable cellulases are also disclosed in WO 91/17243 to Novo, WO 96/34092, WO 96/34945 and EP-A-0,739,982. In practical terms for current commercial preparations, typical amounts are up to 5 mg by weight, more typically 0.01 mg to 3 mg, of active enzyme per gram of the detergent composition. Stated otherwise, the compositions herein will typically comprise from 0.001% to 5%, preferably 0.01%–1% by weight of a commercial enzyme preparation. In the particular cases where activity of the enzyme preparation can be defined otherwise such as with cellulases, corresponding activity units are preferred (e.g. CEVU or cellulase Equivalent Viscosity Units). For instance, the compositions of the present invention can contain cellulase enzymes at a level equivalent to an activity from 0.5 to 1000 CEVU/gram of composition. Cellulase enzyme preparations used for the purpose of formulating the compositions of this invention typically have an activity comprised between 1,000 and 10,000 CEVU/gram in liquid form, around 1,000 CEVU/gram in solid form.

Other Optional Ingredients

The present invention can include optional components conventionally used in textile treatment compositions, for example: brighteners, colorants; surfactants; anti-shrinkage agents; fabric crisping agents; spotting agents; germicides; fungicides; anti-oxidants such as butylated hydroxy toluene, anti-corrosion agents, antifoam agents, and the like.

The present invention can also include other compatible ingredients, including those as disclosed in WO96/02625, WO96/21714, and WO96/21715, and dispersible polyolefin such as Velustrol® as disclosed in co-pending application PCT/US 97/01644, and the like. The present invention can also contain optional chelating agents.

The benefit provided by the use of the present invention is that the polyamino functional polymer containing composition is stabilised by means of the CGI. Accordingly, in an aspect of the invention, there is provided the use of a crystal growth inhibitor to stabilise compositions comprising amino-functional polymer.

As a consequence, the compositions of the invention provide better care to the fabrics compared to compositions which do not have such stabilisation means. Accordingly, in another aspect of the invention, there is provided a method for providing care to the color fabrics which comprises the steps of contacting the fabrics with a composition of the invention.

The color care benefit may either be assessed visually or by determination of the so-called delta-E values.

When the visual assessment is used, a panel of expert graders visually compare, according to the established panel score unit (PSU) scales, fabrics treated with and without the composition according to the present invention. A positive PSU value indicates a better performance (PSU scale: 0=no difference, 1=I think there is a difference, 2=I know there is a difference, 3=I know there is a lot of difference, 4=I know there is a whole lot of difference).

Another method for the assessment of the color care benefit to fabrics is the determination of the so-called delta-E values. Delta E's are defined, for instance, in ASTM D2244. Delta E is the computed color difference as defined in ASTM D2244, i.e. the magnitude and direction of the difference between two psychophysical color stimuli defined by tristimulus values, or by chromaticity coordinates and luminance factor, as computed by means of a specified set of color-difference equations defined in the CIE 1976 CIELAB opponent-color space, the Hunter opponent-color space, the Friele-Mac Adam-Chickering color space or any equivalent color space.

Applications

The compositions of the invention are suitable for use in any steps of the domestic treatment, that is as a pretreatment composition, as a wash additive as a composition suitable for use in the rinse-cycle of the laundry cycle or applied on a dryer-sheet. Obviously, for the purpose of the invention, multiple applications can be made such as treating the fabric with a pre-treatment composition of the invention and also thereafter with a composition of the invention suitable for use in the rinse cycle and/or suitable for use as a dryer-sheet. The compositions of the invention may also be in a spray, foam, or aerosol form which for example can be suitable for use while ironing, or applied on the surfaces of the tumble dryer.

The invention is illustrated in the following non limiting examples, in which all percentages are on an active weight basis unless otherwise stated.

In the examples, the abbreviated component identifications have the following meanings:

| | |
|---|---|
| DEQA: | Di-(tallowyl-oxy-ethyl) dimethyl ammonium chloride |
| DOEQA: | Di-(oleyloxyethyl) dimethyl ammonium methylsulfate |
| DTDMAC: | Ditallow dimethylammonium chloride |
| DHEQA: | Di-(soft-tallowyl-oxy-ethyl) hydroxyethyl methyl ammonium methylsulfate |
| Fatty acid: | tallow fatty acid IV = 18 |
| Electrolyte: | Calcium chloride |
| DTDMAMS: | Ditallow dimethyl ammonium methylsulfate |
| SDASA: | 1:2 Ratio of stearyldimethyl amine:triple-pressed stearic acid |
| Glycosperse S-20: | Polyethoxylated sorbitan monostearate available from Lonza |
| Clay: | Calcium Bentonite Clay, Bentonite L, sold by Southern Clay Products |
| TAE25: | Tallow alcohol ethoxylated with 25 moles of ethylene oxide per mole of alcohol |
| PEG: | Polyethylene Glycol 4000 |
| PEI 1800 E1: | Ethoxylated polyethylene imine (MW 1800, at 50% active) as synthesised in Synthesis example 1 |
| PEI 1800 E3: | Ethoxylated polyethylene imine (MW 1800, at 50% active) as synthesised as per Synthesis example 1 |
| PEI 1800 E7 AO: | Amine oxide of ethoxylated polyethylene imine (MW 1800, at 50% active) as synthesised as per Synthesis example 4 |
| PEI 1200 E1: | Ethoxylated polyethylene imine (MW 1200, at 50% active in water) as synthesised in Synthesis example 5 |
| PEI 1200 E2: | Ethoxylated polyethylene imine (MW 1200, at 50% active in water) as synthesised per Synthesis example 5 |
| PEI 1200 E4: | Ethoxylated polyethylene imine (MW 1200, at 50% active in water) as synthesised per Synthesis example 5 |
| PEI 1200 E7: | Ethoxylated polyethylene imine (MW 1200, at 50% active in water) as synthesised per Synthesis example 5 |
| PEI 1200 E7 AO: | Amine oxide of ethoxylated polyethylene imine (MW 1200, at 50% active) as synthesised as per Synthesis example 5 and 4 |
| Dye Fix 1: | Cationic dye fixing agent (50% active) available under the tradename Tinofix Eco from Ciba-Geigy |
| Dye Fix 2: | Emulsified cationic dye fixative (30% active) available under the tradename Rewin SRF-O from CHT-Beitlich |
| NH4Cl: | Ammonium chloride |
| LAS: | Sodium linear $C_{12}$ alkyl benzene sulphonate |
| TAS: | Sodium tallow alcohol sulphate |
| C25AS: | Sodium $C_{12}$–$C_{15}$ linear alkyl sulphate |
| CxyEzS: | Sodium $C_{1x}$–$C_{1y}$ branched alkyl sulphate condensed with z moles of ethylene oxide |
| C45E7: | A $C_{14-15}$ predominantly linear primary alcohol condensed with an average of 7 moles of ethylene oxide |
| C25 E3: | A $C_{12-15}$ branched primary alcohol condensed with an average of 3 moles of ethylene oxide |
| Cationic ester: | Mixture of $C_{12}/C_{14}$ choline ester |
| Soap: | Sodium linear alkyl carboxylate derived from an 80/20 mixture of tallow and a coconut oils. |
| TFAA: | $C_{16}$–$C_{18}$ alkyl N-methyl glucamide |
| TPKFA: | C12–C14 topped whole cut fatty acids |
| Zeolite A: | Hydrated Sodium Aluminosilicate of formula $Na_{12}(A10_2SiO_2)_{12}$. $27H_2O$ having a primary particle size in the range from 0.1 to 10 micrometers |

-continued

| | |
|---|---|
| Citric acid: | Anhydrous citric acid |
| Carbonate: | Anhydrous sodium carbonate with a particle size between 200 μm and 900 μm |
| Silicate: | Amorphous Sodium Silicate ($SiO_2$:$Na_2O$; 2.0 ratio) |
| Sulphate: | Anhydrous sodium sulphate |
| Citrate: | Tri-sodium citrate dihydrate of activity 86.4% with a particle size distribution between 425 μm and 850 μm |
| MA/AA: | Copolymer of 1:4 maleic/acrylic acid, average molecular weight about 70,000. |
| CMC: | Sodium carboxymethyl cellulose |
| Savinase: | Proteolytic enzyme of activity 4KNPU/g |
| Carezyme: | Cellulytic enzyme of activity 1000 CEVU/g |
| Termamyl: | Amylolytic enzyme of activity 60KNU/g |
| Lipolase: | Lipolytic enzyme of activity 100kLU/g |
| | all sold by NOVO Industries A/S and of activity mentioned above unless otherwise specified |
| PB4: | Sodium perborate tetrahydrate of nominal formula $NaBO_2.3H_2O.H_2O_2$ |
| PB1: | Anhydrous sodium perborate bleach of nominal formula $NaBO_2.H_2O_2$ |
| TAED: | Tetraacetyl ethylene diamine |
| DTPMP: | Diethylene triamine penta (methylene phosphonate), marketed by Monsanto under the Trade name Dequest 2060 |
| Photoactivated: | Sulphonated Zinc Phthalocyanin encapsulated in bleach dextrin soluble polymer |
| Brightener: | Disodium 4,4'-bis(4-anilino-6-morpholino-1.3.5-triazin-2-yl)amino) stilbene-2:2'-disulphonate. |
| Silicone antifoam: | Polydimethyldiloxane foam controller with Siloxane-oxyalkylene copolymer as dispersing agent with a ratio of said foam controller to said dispersing agent of 10:1 to 100:1. |
| HEDP: | 1,1-hydroxyethane diphosphonic acid |
| PBT: | 2-phosphonobutane-1,2,4-tricarboxylic acid |
| Polycarboxylic: | Polycarboxylic compound marketed by BASF under the tradename Sokalan CP 10 |
| Glycolic: | Glycolic acid |

Synthesis Example 1

Preparation of PEI 1800 $E_1$

Step A)—The ethoxylation is conducted in a 2 gallon stirred stainless steel autoclave equipped for temperature measurement and control, pressure measurement, vacuum and inert gas purging, sampling, and for introduction of ethylene oxide as a liquid. A ~20 lb. net cylinder of ethylene oxide (ARC) is set up to deliver ethylene oxide as a liquid by a pump to the autoclave with the cylinder placed on a scale so that the weight change of the cylinder could be monitored.

A 750 g portion of polyethyleneimine (PEI) (Nippon Shokubai, Epomin SP-018 having a listed average molecular weight of 1800 equating to 0.417 moles of polymer and 17.4 moles of nitrogen functions) is added to the autoclave. The autoclave is then sealed and purged of air (by applying vacuum to minus 28" Hg followed by pressurization with nitrogen to 250 psia, then venting to atmospheric pressure). The autoclave contents are heated to 130° C. while applying vacuum. After about one hour, the autoclave is charged with nitrogen to about 250 psia while cooling the autoclave to about 105° C. Ethylene oxide is then added to the autoclave incrementally over time while closely monitoring the autoclave pressure, temperature, and ethylene oxide flow rate. The ethylene oxide pump is turned off and cooling is applied to limit any temperature increase resulting from any reaction exotherm. The temperature is maintained between 100 and 110° C. while the total pressure is allowed to gradually increase during the course of the reaction. After a total of 750 grams of ethylene oxide has been charged to the autoclave (roughly equivalent to one mole ethylene oxide per PEI nitrogen function), the temperature is increased to 110° C. and the autoclave is allowed to stir for an additional hour. At this point, vacuum is applied to remove any residual unreacted ethylene oxide.

Step B)—The reaction mixture is then deodorized by passing about 100 cu. ft. of inert gas (argon or nitrogen) through a gas dispersion frit and through the reaction mixture while agitating and heating the mixture to 130° C.

The final reaction product is cooled slightly and collected in glass containers purged with nitrogen.

In other preparations the neutralization and deodorization is accomplished in the reactor before discharging the product.

If a PEI 1800 $E_7$ is desired, the following step of catalyst addition will be included between Step A and B.

Vacuum is continuously applied while the autoclave is cooled to about 50° C. while introducing 376 g of a 25% sodium methoxide in methanol solution (1.74 moles, to achieve a 10% catalyst loading based upon PEI nitrogen functions). The methoxide solution is sucked into the autoclave under vacuum and then the autoclave temperature controller setpoint is increased to 130° C. A device is used to monitor the power consumed by the agitator. The agitator power is monitored along with the temperature and pressure. Agitator power and temperature values gradually increase as methanol is removed from the autoclave and the viscosity of the mixture increases and stabilizes in about 1 hour indicating that most of the methanol has been removed. The mixture is further heated and agitated under vacuum for an additional 30 minutes.

Vacuum is removed and the autoclave is cooled to 105° C. while it is being charged with nitrogen to 250 psia and then vented to ambient pressure. The autoclave is charged to 200 psia with nitrogen. Ethylene oxide is again added to the autoclave incrementally as before while closely monitoring the autoclave pressure, temperature, and ethylene oxide flow rate while maintaining the temperature between 100 and 110° C. and limiting any temperature increases due to reaction exotherm. After the addition of 4500 g of ethylene oxide (resulting in a total of 7 moles of ethylene oxide per mole of PEI nitrogen function) is achieved over several hours, the temperature is increased to 110° C. and the mixture stirred for an additional hour.

The reaction mixture is then collected in nitrogen purged containers and eventually transferred into a 22 L three neck round bottomed flask equipped with heating and agitation. The strong alkali catalyst is neutralized by adding 167 g methanesulfonic acid (1.74 moles).

Other preferred examples such as PEI 1800 E2, PEI 1800 E3, PEI 1800 E15 and PEI 1800 E20 can be prepared by the above method by adjusting the reaction time and the relative amount of ethylene oxide used in the reaction.

Synthesis Example 2

4.7% Quaternization of PEI 1800 E7

To a 500 ml erlenmeyer flask equipped with a magnetic stirring bar is added poly(ethyleneimine), MW 1800 ethoxylated to a degree of 7 (224 g, 0.637 mol nitrogen, prepared as in Synthesis Example 1) and acetonitrile (Baker, 150 g, 3.65 mol). Dimethyl sulfate (Aldrich, 3.8 g, 0.030 mol) is added all at once to the rapidly stirring solution, which is then stoppered and stirred at room temperature overnight. The acetonitrile is evaporated on the rotary evaporator at ~60° C., followed by a Kugelrohr apparatus (Aldrich) at ~80° C. to afford ~220 g of the desired material as a dark brown viscous liquid. A $^{13}$C-NMR ($D_2O$) spectrum shows the absence of a peak at ~58 ppm corresponding to dimethyl sulfate. A $^{1}$H-NMR ($D_2O$) spectrum shows the partial shifting of the peak at 2.5 ppm (methylenes attached to unquaternized nitrogens) to ~3.0 ppm.

Synthesis Example 3

Oxidation of 4.7% Quaternized PEI 1800 E7

To a 500 ml erlenmeyer flask equipped with a magnetic stirring bar is added poly(ethyleneimine), MW 1800 which has been ethoxylated to a degree of 7, and ~4.7% quaternized with dimethyl sulfate (121.7 g, ~0.32 mol oxidizeable nitrogen, prepared as in Synthesis Example 2), hydrogen peroxide (Aldrich, 40 g of a 50 wt % solution in water, 0.588 mol), and water (109.4 g). The flask is stoppered, and after an initial exotherm the solution is stirred at room temperature overnight. A $^{1}$H-NMR ($D_2O$) spectrum shows the total shifting of the methylene peaks at 2.5–3.0 ppm to ~3.5 ppm. To the solution is added ~5 g of 0.5% Pd on alumina pellets, and the solution is allowed to stand at room temperature for ~3 days. Peroxide indicator paper shows that no peroxide is left in the system. The material is stored as a 46.5% solution in water.

Synthesis Example 4

Formation of Amine Oxide of PEI 1800 $E_7$

To a 500 mL Erlenmeyer flask equipped with a magnetic stirring bar is added polyethyleneimine having a molecular weight of 1800 and ethoxylated to a degree of about 7 ethoxy groups per nitrogen (PEI-1800, $E_7$) (209 g, 0.595 mol nitrogen, prepared as in Synthesis Example I), and hydrogen peroxide (120 g of a 30 wt % solution in water, 1.06 mol). The flask is stoppered, and after an initial exotherm the solution is stirred at room temperature overnight. $^{1}$H-NMR ($D_2O$) spectrum obtained on a sample of the reaction mixture indicates complete conversion. The resonances ascribed to methylene protons adjacent to unoxidized nitrogens have shifted from the original position at ~2.5 ppm to ~3.5 ppm. To the reaction solution is added approximately 5 g of 0.5% Pd on alumina pellets, and the solution is allowed to stand at room temperature for approximately 3 days. The solution is tested and found to be negative for peroxide by indicator paper. The material as obtained is suitably stored as a 51.1% active solution in water.

Synthesis Example 5

Preparation of PEI 1200 $E_1$

Step A)—The ethoxylation is conducted in a 2 gallon stirred stainless steel autoclave equipped for temperature measurement and control, pressure measurement, vacuum and inert gas purging, sampling, and for introduction of ethylene oxide as a liquid. A ~20 lb. net cylinder of ethylene oxide (ARC) is set up to deliver ethylene oxide as a liquid by a pump to the autoclave with the cylinder placed on a scale so that the weight change of the cylinder could be monitored.

A 750 g portion of polyethyleneimine (PEI) (having a listed average molecular weight of 1200 equating to about 0.625 moles of polymer and 17.4 moles of nitrogen functions) is added to the autoclave. The autoclave is then sealed and purged of air (by applying vacuum to minus 28" Hg followed by pressurization with nitrogen to 250 psia, then venting to atmospheric pressure). The autoclave contents are heated to 130° C. while applying vacuum. After about one hour, the autoclave is charged with nitrogen to about 250 psia while cooling the autoclave to about 105° C.

Ethylene oxide is then added to the autoclave incrementally over time while closely monitoring the autoclave pressure, temperature, and ethylene oxide flow rate. The ethylene oxide pump is turned off and cooling is applied to limit any temperature increase resulting from any reaction exotherm. The temperature is maintained between 100 and 110° C. while the total pressure is allowed to gradually increase during the course of the reaction. After a total of 750 grams of ethylene oxide has been charged to the autoclave (roughly equivalent to one mole ethylene oxide per PEI nitrogen function), the temperature is increased to 110° C. and the autoclave is allowed to stir for an additional hour. At this point, vacuum is applied to remove any residual unreacted ethylene oxide.

Step B)—The reaction mixture is then deodorized by passing about 100 cu. ft. of inert gas (argon or nitrogen) through a gas dispersion frit and through the reaction mixture while agitating and heating the mixture to 130° C.

The final reaction product is cooled slightly and collected in glass containers purged with nitrogen.

In other preparations the neutralization and deodorization is accomplished in the reactor before discharging the product.

If a PEI 1200 $E_7$ is desired, the following step of catalyst addition will be included between Step A and B.

Vacuum is continuously applied while the autoclave is cooled to about 50° C. while introducing 376 g of a 25% sodium methoxide in methanol solution (1.74 moles, to achieve a 10% catalyst loading based upon PEI nitrogen functions). The methoxide solution is sucked into the autoclave under vacuum and then the autoclave temperature controller setpoint is increased to 130° C. A device is used to monitor the power consumed by the agitator. The agitator power is monitored along with the temperature and pressure. Agitator power and temperature values gradually increase as methanol is removed from the autoclave and the viscosity of the mixture increases and stabilizes in about 1 hour indicating that most of the methanol has been removed. The mixture is further heated and agitated under vacuum for an additional 30 minutes.

Vacuum is removed and the autoclave is cooled to 105° C. while it is being charged with nitrogen to 250 psia and then vented to ambient pressure. The autoclave is charged to 200 psia with nitrogen. Ethylene oxide is again added to the autoclave incrementally as before while closely monitoring the autoclave pressure, temperature, and ethylene oxide flow rate while maintaining the temperature between 100 and 110° C. and limiting any temperature increases due to reaction exotherm. After the addition of 4500 g of ethylene oxide (resulting in a total of 7 moles of ethylene oxide per mole of PEI nitrogen function) is achieved over several hours, the temperature is increased to 110° C. and the mixture stirred for an additional hour.

The reaction mixture is then collected in nitrogen purged containers and eventually transferred into a 22 L three neck round bottomed flask equipped with heating and agitation. The strong alkali catalyst is neutralized by adding 167 g methanesulfonic acid (1.74 moles).

Other preferred examples such as PEI 1200 E2, PEI 1200 E3, PEI 1200 E15 and PEI 1200 E20 can be prepared by the above method by adjusting the reaction time and the relative amount of ethylene oxide used in the reaction.

The corresponding amine oxide of the above ethoxylated PEI can also be prepared following synthesis Example 4.

Synthesis Example 6

9.7% Quaternization of PEI 1200 E7

To a 500 ml erlenmeyer flask equipped with a magnetic stirring bar is added poly(ethyleneimine), MW 1200 ethoxylated to a degree of 7 (248.4 g, 0.707 mol nitrogen, prepared as in Synthesis Example 5) and acetonitrile (Baker, 200 mL). Dimethyl sulfate (Aldrich, 8.48 g, 0.067 mol) is added all at once to the rapidly stirring solution, which is then stoppered and stirred at room temperature overnight. The acetonitrile is evaporated on the rotary evaporator at ~60° C., followed by a Kugelrohr apparatus (Aldrich) at ~80° C. to afford ~220 g of the desired material as a dark brown viscous liquid. A $^{13}$C-NMR ($D_2O$) spectrum shows the absence of a peak at ~58 ppm corresponding to dimethyl sulfate. A $^{1}$H-NMR ($D_2O$) spectrum shows the partial shifting of the peak at 2.5 ppm (methylenes attached to unquaternized nitrogens) to ~3.0 ppm.

Synthesis Example 7

4.7% Oxidation of 9.5% Quaternized PEI 1200 E7

To a 500 ml erlenmeyer flask equipped with a magnetic stirring bar is added poly(ethyleneimine), MW 1200 which has been ethoxylated to a degree of 7, and ~9.5% quaternized with dimethyl sulfate (144 g, ~0.37 mol oxidizeable nitrogen, prepared as in Example 6), hydrogen peroxide (Aldrich, 35.4 g of a 50 wt % solution in water, 0.52 mol), and water (100 g). The flask is stoppered, and after an initial exotherm the solution is stirred at room temperature overnight. A $^{1}$H-NMR ($D_2O$) spectrum shows the total shifting of the methylene peaks at 2.5–3.0 ppm to ~3.5 ppm. To the solution is added just enough sodium bisulfite as a 40% water solution to bring the residual peroxide level down to 1–5 ppm. The sodium sulfate which forms causes an aqueous phase to separate which contains salts, but little or no organics. The aqueous salt phase is removed and the desired oxidized polyethyleneimine derivative is obtained and stored as a 52% solution in water.

EXAMPLE 1

The following compositions are in accordance with the present invention

| Component | A | B | C | D | E | F | G | H |
|---|---|---|---|---|---|---|---|---|
| DEQA | 2.6 | 2.9 | 18.0 | 19.0 | 19.0 | — | — | — |
| TAE25 | | — | 1.0 | — | — | — | — | — |
| Fatty acid | 0.3 | — | 1.0 | — | — | — | — | — |
| Hydrochloride acid | 0.02 | 0.02 | 0.02 | 0.02 | 0.02 | — | — | — |
| PEG | — | — | 0.6 | 0.6 | 0.6 | — | — | — |
| Perfume | 1.0 | 1.0 | 1.0 | 1.0 | 1.0 | 0.1 | 0.1 | 0.1 |
| Silicone antifoam | 0.01 | 0.01 | 0.01 | 0.01 | 0.01 | — | — | — |
| PEI 1200 E1 | 3 | 3 | 3 | 3 | — | 15 | — | 10 |
| PEI 1200 E2 | — | | | | 3 | | 10 | — |
| Dye fix 1 | — | 1 | 1 | 1 | — | — | 10 | — |
| Dye fix 2 | — | 2 | 2 | 2 | — | — | — | — |
| HEDP | 0.2 | — | — | 0.2 | — | 0.4 | — | 0.8 |
| Glycolic | — | 0.2 | — | — | 0.5 | — | 0.4 | — |
| Poly-carboxylate | — | — | 0.5 | — | — | 0.4 | — | — |

-continued

| | | | | | | | | |
|---|---|---|---|---|---|---|---|---|
| Electrolyte (ppm) | — | — | 600 | 600 | 1200 | — | — | — |
| Dye (ppm) | 10 | 10 | 50 | 50 | 50 | — | — | — |
| Water and minors to balance to 100 | | | | | | | | |

| Component | I | J | K | L | M |
|---|---|---|---|---|---|
| DEQA | 2.6 | 19.0 | — | — | — |
| Fatty acid | 0.3 | — | — | — | — |
| Hydrochloride acid | 0.02 | 0.02 | — | — | — |
| PEG | — | 0.6 | — | — | — |
| Perfume | 1.0 | 1.0 | 0.1 | 0.1 | 0.2 |
| Silicone antifoam | 0.01 | 0.01 | — | — | — |
| PEI 1200 E1 | 3 | 3 | 15 | — | 10 |
| PEI 1200 E4 | — | — | — | 10 | — |
| Dye fix 1 | — | 1 | — | — | 2.5 |
| Dye fix 2 | — | 2 | — | — | — |
| PBT | 0.2 | 0.2 | 0.4 | 0.8 | 0.5 |
| Polycarboxylate | — | — | 0.4 | — | — |
| Electrolyte (ppm) | — | 600 | — | — | — |
| Dye (ppm) | 10 | 50 | — | — | — |
| Water and minors to balance to 100 | | | | | |

| Component | N | O | P | Q | R | S |
|---|---|---|---|---|---|---|
| DTDMAC | — | — | — | 15 | — | — |
| DEQA | 2.6 | 19.0 | — | — | 2.6 | 19.0 |
| TAE25 | 0.3 | — | — | — | 0.3 | — |
| Fatty acid | 0.3 | — | — | — | 0.3 | — |
| Hydrochloride acid | 0.02 | 0.02 | — | 0.02 | 0.02 | 0.02 |
| PEG | — | 0.6 | — | 0.6 | — | 0.6 |
| Perfume | 1.0 | 1.0 | 0.1 | 1.0 | 1.0 | 1.0 |
| Silicone antifoam | 0.01 | 0.01 | — | 0.01 | 0.01 | 0.01 |
| PEI 1800 E1 | 3 | 3 | 10 | 3 | 3 | 3 |
| HEDP | 0.2 | 0.2 | — | — | — | — |
| PBT | — | — | — | — | 0.2 | 0.2 |
| Glycolic | — | — | 0.2 | — | — | — |
| polycarboxylic | — | — | — | 0.2 | — | — |
| Dye fix 1 | 1 | 1 | 10 | 1 | 1 | 1 |
| Dye fix 2 | 2 | 2 | — | 2 | 2 | 2 |
| Electrolyte (ppm) | — | 600 | — | 600 | — | 600 |
| Dye (ppm) | 10 | 50 | — | 50 | 10 | 50 |
| Water and minors to balance to 100 | | | | | | |

EXAMPLE 2

The following compositions for use as dryer-added sheets are in accordance with the invention

| | T | U | V | W | X | Y | Z | AA | BB |
|---|---|---|---|---|---|---|---|---|---|
| DOEQA | 40 | 40 | 25 | — | — | — | — | — | — |
| DHEQA | — | — | — | 20 | 20 | — | — | — | — |
| DTDMAMS | — | — | — | — | — | 20 | 20 | 12 | 60 |
| SDASA | 30 | 30 | 30 | 20 | 20 | 30 | 30 | 20 | — |
| Glycosperse S-20 | — | — | — | 10 | 10 | — | — | — | — |
| Glycerol Monostearate | — | — | — | — | — | 20 | 20 | 10 | — |
| Clay | 4 | 4 | 4 | 3 | 3 | 4 | 4 | 4 | — |
| Perfume | 0.7 | 0.7 | 1.1 | 0.7 | 0.7 | 1.6 | 1.6 | 2.6 | 1.4 |
| PEI 1800 E4 | — | — | 5 | — | — | — | — | — | — |
| PEI 1200 E1 | — | — | — | 4 | 4 | 2.2 | 2.2 | — | — |
| PEI 1800 E3 | 2 | 2 | — | — | — | — | — | 5 | 7.0 |
| Dye fix 1 | 2 | 2 | 5 | 4 | 4 | 2.2 | 2.2 | 5 | 3 |
| HEDP | 0.2 | — | — | 0.5 | — | — | — | — | 0.7 |
| BPT | — | 0.2 | — | — | 0.9 | — | 0.2 | | |
| Glycolic | — | — | 0.2 | — | — | 0.2 | — | — | — |
| Polycarboxylic | — | — | 0.2 | — | — | — | — | 0.4 | — |
| Stearic acid to balance | | | | | | | | | |

EXAMPLE 3

The following detergent formulations, are in accordance with the present invention:

| | CC | DD | EE |
|---|---|---|---|
| Zeolite A | 24.0 | 23.0 | 23.0 |
| Sulphate | 9.0 | — | — |
| MA/AA | 4.0 | 4.0 | 4.0 |
| LAS | 8.0 | 8.0 | 8.0 |
| TAS | — | 2.0 | 2.0 |
| Silicate | 3.0 | 3.0 | 3.0 |
| CMC | 1.0 | 0.4 | 0.4 |
| Brightener | 0.2 | — | — |
| Soap | 1.0 | — | — |
| DTPMP | 0.4 | 0.4 | 0.4 |
| C45E7 | 2.5 | 2.0 | 2.0 |
| C25E3 | 2.5 | 2.0 | 2.0 |
| Silicone antifoam | 0.3 | 5.0 | 5.0 |
| Perfume | 0.3 | 0.3 | 0.3 |
| Carbonate | 13.0 | 16.0 | 16.0 |
| Citrate | — | 5.0 | 5.0 |
| PB4 | 18.0 | — | — |
| PB1 | 4.0 | 14.0 | 14.0 |
| TAED | 3.0 | 6.0 | 6.0 |
| Photoactivated bleach | 0.02% | — | — |
| Savinase | 1.0 | 1.0 | 1.0 |
| Lipolase | 0.4 | 0.4 | 0.4 |
| Termamyl | 0.30 | 0.6 | 0.6 |
| Carezyme | — | 0.6 | 0.6 |
| PEI 1800 E7 AO | 1.0 | — | — |
| PEI 1200 E7 AO | — | 1.0 | 1.0 |
| HEDP | 0.2 | — | — |
| BPT | — | — | 0.2 |
| Glycolic | — | 0.2 | 0.2 |
| Polycarboxylic | — | 0.2 | 0.2 |
| Balance (Moisture and Miscellaneous) to 100 | | | |

EXAMPLE 4

The following liquid detergent formulation, according to the present invention was prepared:

| | FF |
|---|---|
| C25AS | 13 |
| C25E3S | 2 |
| TFAA | 6 |
| C12–14 alkyl dimethylhydroxy ethyl ammonium chloride | 1 |
| Cationic ester | 1.5 |
| TPKFA | 15 |
| Citric acid | 1 |
| Ethanol | 2 |
| 1,2 Propanediol | 8 |
| NaOH up to pH | 7.5 |
| DTPMP | 1.2 |
| Savinase | 0.5 |
| Termamyl (300 KNU/g) | 0.15 |
| Boric acid | 1.5 |
| Softening clay of the bentonite type | 4 |
| Suspending clay SD3 | 0.3 |
| PEI 1200 E7 | 1 |
| HEDP | 0.2 |
| Balance (Moisture and Miscellaneous) | 100 |

What is claimed is:

1. A fabric care composition comprising a polyamine functional polymer having a molecular weight between 200 and 10,000, and a crystal growth inhibitor selected from the group consisting of carboxylic compounds, organic mono and diphosphonic acids, and salts and complexes thereof, and mixtures thereof, wherein, when said crystal growth inhibitor is selected from carboxylic acid, organic diphosphonic acid, and mixtures thereof, the crystal growth inhibitor is present in an amount of less than 1% by weight of the composition.

2. A composition according to claim 1, wherein said polymer comprises a polyamine backbone corresponding to the formula:

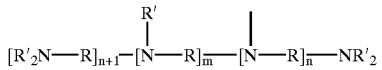

having a polyamine formula $V_{(n+1)}W_mY_nZ$ or a polyamine backbone corresponding to the formula:

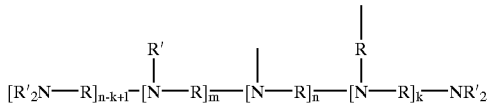

having a polyamine formula $V_{(n-k+1)}W_mY_nY'_kZ$, wherein k is less than or equal to n, said polyamine backbone has a molecular weight greater than 200 daltons, wherein i) V units are terminal units having the formula:

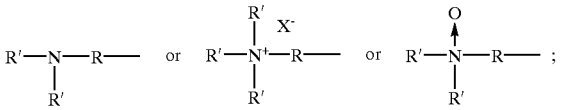

ii) W units are backbone units having the formula:

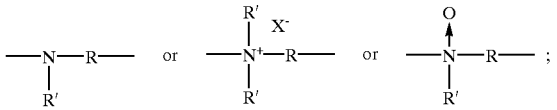

iii) Y units are branching units having the formula:

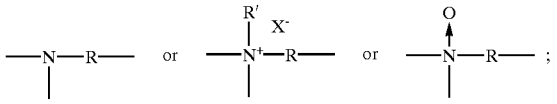

and iv) Y' units are branch point for a backbone or branch ring having the formula:

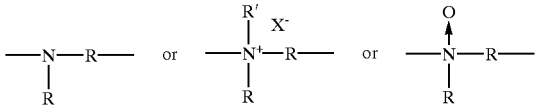

v) Z units are terminal units having the formula:

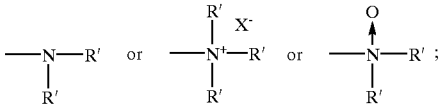

wherein backbone linking R units are selected from the group consisting of $C_2$–$C_{12}$ alkylene, $C_4$–$C_{12}$ alkenylene, $C_3$–$C_{12}$ hydroxyalkylene, $C_4$–$C_{12}$ dihydroxy-alkylene, $C_8$–$C_{12}$ dialkylarylene, $—(R^1O)_xR^1—$, $—(R^1O)_xR^5(OR^1)_x—$, $—(CH_2CH(OR^2)CH_2O)_z(R^1O)_yR^1(OCH_2CH(OR^2)CH_2)_w—$, $—C(O)(R^4)_rC(O)—$, $—CH_2CH(OR^2)CH_2—$, and mixtures thereof;

wherein $R^1$ is selected from the group consisting of $C_2$–$C_6$ alkylene and mixtures thereof; $R^2$ is selected from the group consisting of hydrogen, —$(R^1O)_xB$, and mixtures thereof; $R^4$ is selected from the group consisting of $C_1$–$C_{12}$ alkylene, $C_4$–$C_{12}$ alkenylene, $C_8$–$C_{12}$ arylalkylene, $C_6$–$C_{10}$ arylene, and mixtures thereof; $R^5$ is selected from the group consisting of $C_1$–$C_{12}$ alkylene, $C_3$–$C_{12}$ hydroxyalkylene, $C_4$–$C_{12}$ dihydroxyalkylene, $C_8$–$C_{12}$ dialkylarylene, —C(O)—, —C(O)$NHR^6NHC(O)$—, —$R^1(OR^1)$—, —$C(O)(R^4)_rC(O)$—, —$CH_2CH(OH)CH_2$—, —$CH_2CH(OH)CH_2O(R^1O)_yR^1OCH_2CH(OH)CH_2$—, and mixtures thereof; $R^6$ is selected from the group consisting of $C_2$–$C_{12}$ alkylene or $C_6$–$C_{12}$ arylene; R' units are selected from the group consisting of hydrogen, $C_1$–$C_{22}$ alkyl, $C_3$–$C_{22}$ alkenyl, $C_7$–$C_{22}$ arylalkyl, $C_2$–$C_{22}$ hydroxyalkyl, —$(CH_2)_pCO_2M$, —$(CH_2)_qSO_3M$, —$CH(CH_2CO_2M)CO_2M$, —$(CH_2)_pPO_3M$, —$(R^1O)_xB$, —$C(O)R^3$, and mixtures thereof; B is selected from the group consisting of hydrogen, $C_1$–$C_6$ alkyl, —$(CH_2)_qSO_3M$, —$(CH_2)_pCO_2M$, —$(CH_2)_q(CHSO_3M)CH_2SO_3M$, —$(CH_2)_q$—$(CHSO_2M)CH_2SO_3M$, —$(CH_2)_pPO_3M$, —$PO_3M$, and mixtures thereof; $R^3$ is selected from the group consisting of $C_1$–$C_{18}$ alkyl, $C_7$–$C_{12}$ arylalkyl, $C_7$–$C_{12}$ alkyl substituted aryl, $C_6$–$C_{12}$ aryl, and mixtures thereof; M is hydrogen or a water soluble cation in sufficient amount to satisfy charge balance; X is a water soluble anion; m has the value from 2 to 700; n has the value from 0 to 350; p has the value from 1 to 6, q has the value from 0 to 6; r has the value of 0 or 1; w has the value 0 or 1; x has the value from 1 to 100; y has the value from 0 to 100; z has the value 0 or 1.

3. A composition according to claim 2, wherein R' units of the amino functional polymer are selected from the group consisting of hydrogen, $C_3$–$C_{22}$ hydroxyalkyl, benzyl, $C_1$–$C_{22}$ alkyl, —$(R^1O)_xB$, —$C(O)R^3$, —$(CH_2)_pCO_2^-M^+$, —$(CH2)_qSO_3^-M^+$, —$CH(CH_2CO_2M)CO_2M$ and mixtures thereof, preferably R' units are selected from the group consisting of hydrogen, $C_1$–$C_{22}$ alkyl, —$(R^1O)_xB$, —$C(O)R^3$, and mixtures thereof.

4. A composition according to claim 3, wherein x has a value lying in the range of from 1 to 20.

5. A composition according to claim 4, wherein said polymer is present in an amount of from 0.01% to 50% active by weight.

6. A composition according to claim 5, wherein said polymer is present in an amount of from 0.1% to 20% active by weight.

7. A composition according to claim 1, wherein said crystal growth inhibitor is selected from carboxylic compounds, organic diphosphonic acids, and mixtures thereof.

8. A composition according to claim 7, wherein said organic diphosphonic compound is hydroxy-ethane 1,1 diphosphonic acid.

9. A composition according to claim 1, wherein said crystal growth inhibitor is present in an amount of from 0.005% to 0.5% by weight of the composition.

10. A composition according to claim 9, wherein said crystal growth inhibitor is present in an amount of from 0.1% to 0.2% by weight of the composition.

11. A composition according to claim 1, wherein said composition further comprises a fabric softener.

12. A composition according to claim 11, wherein said softener is a cationic fabric softener, selected from (1)

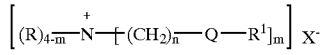

or the formula:

(2)

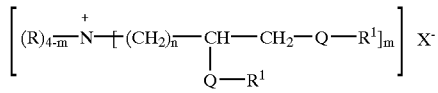

wherein Q is a carbonyl unit having the formula:

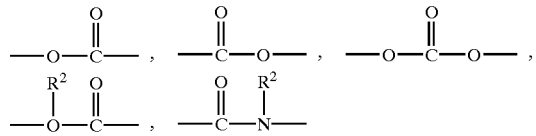

each R unit is independently hydrogen, $C_1$–$C_6$ alkyl, $C_1$–$C_6$ hydroxyalkyl, and mixtures thereof, preferably methyl or hydroxy alkyl;

each $R^1$ unit is independently linear or branched $C_{11}$–$C_{22}$ alkyl, linear or branched $C_{11}$–$C_{22}$ alkenyl, and mixtures thereof, $R^2$ is hydrogen, $C_1$–$C_4$ alkyl, $C_1$–$C_4$ hydroxyalkyl, and mixtures thereof;

X is an anion which is compatible with fabric softener;

the index m is from 1 to 4;

the index n is from 1 to 4.

13. A composition according to claim 1, wherein said composition further comprises a dye fixing agent.

14. A composition according to claim 1, wherein said composition is in liquid form.

15. A method for stabilizing a composition comprising amino-functional polymer having a molecular weight between 200 and 10,000, which comprises the step of contacting said composition with a crystal growth inhibitor selected from the group consisting of carboxylic compounds, organic mono and diphosphonic acids, and salts and complexes thereof, and mixtures thereof.

16. A method for providing care to colored fabric which comprises the step of contacting the fabric with a composition according to claim 1.

17. A composition according to claim 1, wherein the crystal growth inhibitor comprises an organic diphosphonic acid.

18. A composition according to claim 1, wherein the polyamine functional polymer has a molecular weight between 200 and 2000.

19. A fabric care composition comprising a polyamine functional polymer and from 0.005 to 0.2 percent by weight of a crystal growth inhibitor selected from the group consisting of carboxylic compounds, organic mono and diphosphonic acids, and salts and complexes thereof, and mixtures thereof.

20. A composition according to claim 19, wherein the polyamine functional polymer has a molecular weight between 200 and 10,000.

21. A composition according to claim 19, wherein the weight ratio of the crystal growth inhibitor to the polymer is from 0.005:1 to 0.1:1.

* * * * *